US005910041A

United States Patent [19]

Duescher

[11] Patent Number: 5,910,041

[45] Date of Patent: Jun. 8, 1999

[54] LAPPING APPARATUS AND PROCESS WITH RAISED EDGE ON PLATEN

[75] Inventor: Wayne O. Duescher, Roseville, Minn.

[73] Assignee: Keltech Engineering, St. Paul, Minn.

[21] Appl. No.: 08/812,012

[22] Filed: Mar. 6, 1997

[51] Int. Cl.[6] ..... B24B 5/00

[52] U.S. Cl. ..... 451/28; 451/494

[58] Field of Search ..... 451/287, 285, 451/41, 28, 494, 259, 548, 538, 526

[56] References Cited

U.S. PATENT DOCUMENTS

| | | | |
|---|---|---|---|
| 648,264 | 4/1900 | Jacobson . | |
| 1,291,572 | 1/1919 | Lorenz . | |
| 1,353,966 | 9/1920 | Lorenz . | |
| 1,353,967 | 9/1920 | Lorenz . | |
| 1,355,345 | 10/1920 | Lorenz . | |
| 1,401,832 | 12/1921 | Taylor . | |
| 1,414,172 | 4/1922 | Brown . | |
| 2,854,829 | 10/1958 | Porter | 64/7 |
| 3,182,428 | 5/1965 | Hannon | 51/118 |
| 3,561,164 | 2/1971 | Dunn | 51/116 |
| 4,010,583 | 3/1977 | Highberg et al. | 51/284 |
| 4,011,689 | 3/1977 | Cozzini | 51/5 D |
| 4,045,919 | 9/1977 | Moritomo | 51/165.77 |
| 4,062,152 | 12/1977 | Mehrer | 51/170 R |
| 4,085,549 | 4/1978 | Hodges | 51/119 |
| 4,194,324 | 3/1980 | Bonora et al. | 51/131.5 |
| 4,336,765 | 6/1982 | Coughlin | 118/50 |
| 4,403,567 | 9/1983 | daCosta et al. | 118/500 |
| 4,483,703 | 11/1984 | Kellar et al. | 65/273 |
| 4,506,184 | 3/1985 | Siddall | 310/328 |
| 4,511,387 | 4/1985 | Kellar et al. | 65/287 |
| 4,567,694 | 2/1986 | Sekiya et al. | 51/209 R |
| 4,593,495 | 6/1986 | Kawakami et al. | 51/118 |
| 4,620,738 | 11/1986 | Schwartz et al. | 294/64.1 |
| 4,707,012 | 11/1987 | Takagi | 294/64.1 |
| 4,709,508 | 12/1987 | Junker | 51/105 R |
| 4,742,651 | 5/1988 | Wittstock | 51/165.9 |
| 4,851,749 | 7/1989 | Forrester | 318/568.11 |
| 4,860,498 | 8/1989 | Gosis | 51/165.77 |
| 4,926,493 | 5/1990 | Junker | 384/490 |
| 4,943,148 | 7/1990 | Mondragon et al. | 350/529 |
| 5,029,555 | 7/1991 | Dietrich et al. | 118/730 |
| 5,062,384 | 11/1991 | Foley et al. | 118/500 |
| 5,109,631 | 5/1992 | Biebesheimer et al. | 51/111 R |

(List continued on next page.)

FOREIGN PATENT DOCUMENTS

| | | | |
|---|---|---|---|
| 225093 | 7/1984 | Germany | 451/494 |
| 4053682 | 2/1992 | Japan | 451/494 |
| 117656 | 7/1917 | United Kingdom | 451/494 |

*Primary Examiner*—Robert A. Rose
*Attorney, Agent, or Firm*—Schwegman, Lundberg, Woessner, and Kluth, P.A.

[57] ABSTRACT

Lapping or polishing at high speeds with fine abrasive particles offers significant advantages in the speed of lapping, savings of time in lapping, and smoothness in the finished articles. An improved lapping system comprises a lapper platen system comprising a rotatable platen having I) a back surface and ii) a front surface, wherein the front surface of the rotating platen facing a work piece has a flat plateau or raised area which is continuous around a perimeter of the front side of said platen and the plateau is elevated with respect to a central area on the front surface. The front surface optionally has vents for air, the platen optionally has a back side to which a shaft is connected (directly or through intermediate connections) to rotate the platen and there is a front side on the platen to which is secured an abrasive sheet by reduced air pressure conveyed through said vents. The back side of the work piece holder is also optionally pivotally connected to a rotating joint which is in turn connected to a shaft which rotates said work piece. It is preferred that a frame for the system has a total weight of at least 200 kg supporting a work piece holder. It is also preferred that the work piece holder is movable on said frame. It is most preferred that the platen is rotated at a rotational velocity sufficient to generate a surface speed of at least 4,000 surface feet per minute (or even more than 20,000 surface feet per minute).

33 Claims, 5 Drawing Sheets

U.S. PATENT DOCUMENTS 5,121,572 6/1992 Hilscher ..... 51/111 R
5,133,285 7/1992 Mahler et al. ..... 118/719
5,140,774 8/1992 Onodera ..... 51/134
5,197,228 3/1993 Sharkey, III et al. ..... 51/165.71
5,205,077 4/1993 Wittstock ..... 51/165 R
5,317,836 6/1994 Hasegawa et al. ..... 51/106 R
5,324,012 6/1994 Aoyama et al. ..... 269/21
5,374,021 12/1994 Kleinman ..... 248/362
5,414,491 5/1995 Bryant ..... 355/73
5,534,073 7/1996 Kinoshita et al. ..... 118/728
5,563,683 10/1996 Kamiya ..... 355/53
5,576,754 11/1996 Korem ..... 347/262
5,584,746 12/1996 Tanaka et al. ..... 451/41
5,584,750 12/1996 Ishida et al. ..... 451/288
5,613,896 3/1997 Haus et al. ..... 451/50
5,624,304 4/1997 Pasch et al. ..... 451/287
5,651,724 7/1997 Kimura et al. ..... 451/41
5,667,433 9/1997 Mallon ..... 451/287
5,690,541 11/1997 Dalke ..... 451/63
5,690,545 11/1997 Clowers et al. ..... 451/359
5,704,827 1/1998 Nishi et al. ..... 451/285
5,762,544 6/1998 Zuniga et al. ..... 451/285

FIG. 9
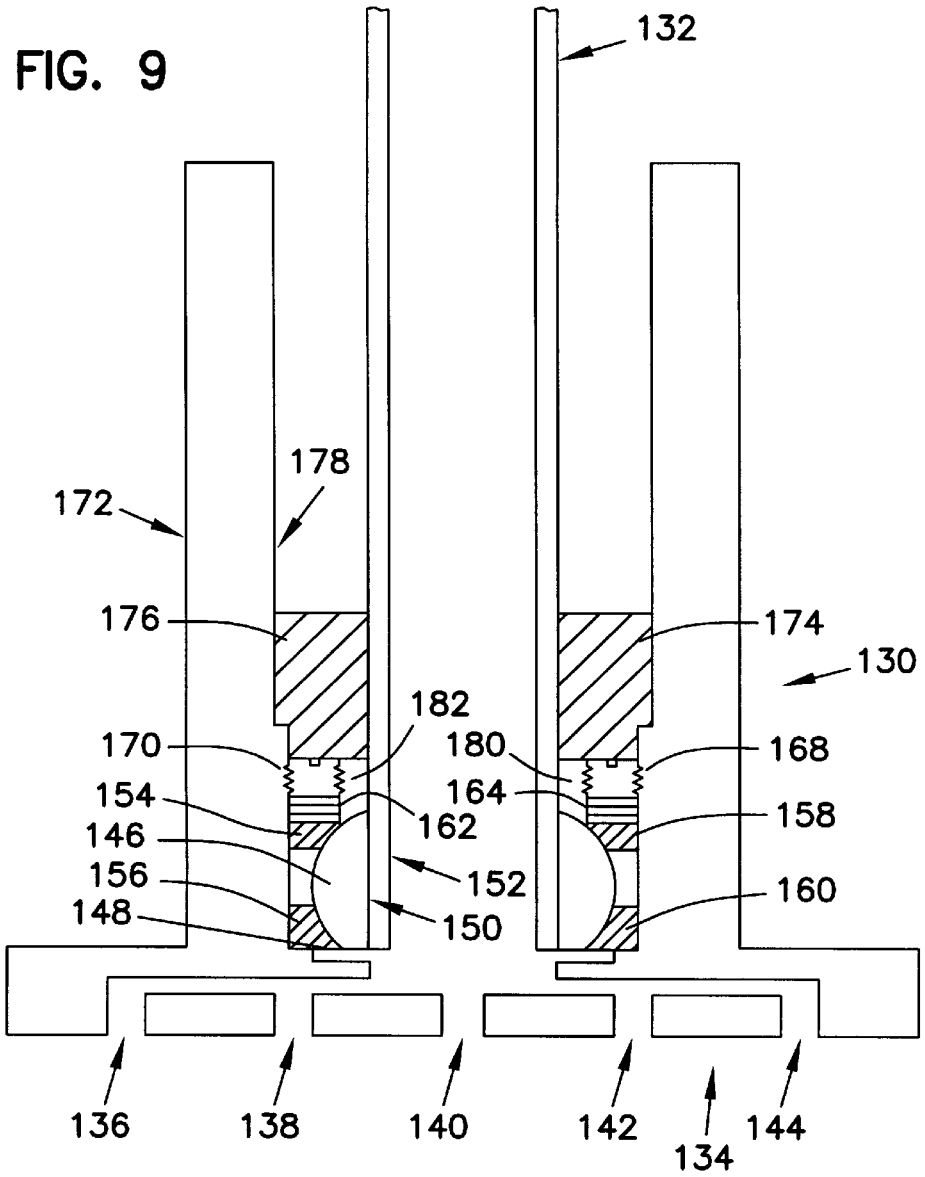
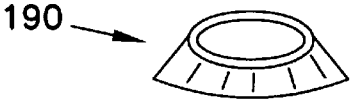
FIG. 10
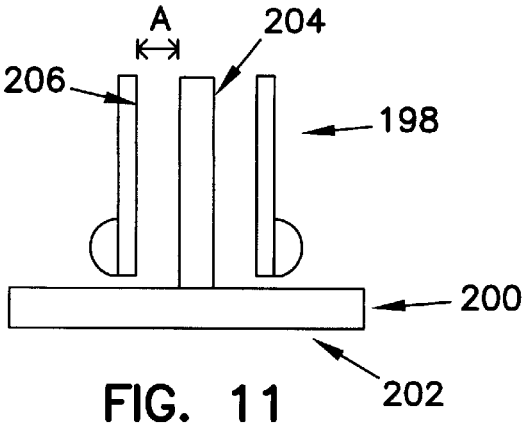
FIG. 11

LAPPING APPARATUS AND PROCESS WITH RAISED EDGE ON PLATEN

BACKGROUND OF THE INVENTION

1. Field of the Invention

The present invention relates to lapping, polishing, finishing or smoothing of surfaces with apparatus and processes which use abrasive sheeting. In particular, the present invention relates to such processes and apparatus which use removable or replaceable abrasive sheeting which operates at high surface speeds, secures said abrasive sheeting to a platen on a flexible shaft which platen moves the sheeting at those high speeds. There is a raised edge on the platen which proffers a lapping surface towards a piece to be polished or lapped. Preferably the abrasive sheet is secured to the raised adge without the use of adhesive layers between the sheeting and the support, and/or which provides a high degree of control over the contact point or contact plane of the abrasive sheeting and the article which is to be lapped, polished, finished or smoothed.

2. Background of the Art

The field of lapping or polishing traces it roots far back into time, even before substantial technical developments. Early jewelry and decorations were provided by minerals or materials (shells or wood) which had been smoothed by natural elements. Stones smoothed by water currents or sand storms gave a much more pleasant look and feel than unpolished stones or stones which had been roughly smoothed by available means such as rubbing two stones together.

Early efforts at sharpening blades for plows or swords were amongst the first technical advances in lapping and smoothing of materials, and these technical means are still used in much the same way today. Swords and plow shears were sharpened by moving the blade against a stone surface. The abrasive action of the stone against the blade removes metal and thins the blade at its edge. Grinding wheels, kitchen knife sharpeners, and the like are not significantly different in function than the stone sharpening tools, such as the grinding wheel which has been used to sharpen blades for thousands of years.

In the $17^{th}$ and $18^{th}$ century the combination of die casting and abrasive polishing enabled the manufacture of interchangeable generic parts for equipment (especially the rifle and hand gun) as opposed to the standard method of fitting individually made parts into a unique piece of equipment with uniquely fitting parts. Each succeeding advance in the ability of materials and processes to create smoother and more uniform surfaces advanced the quality and capability of the resultant articles to perform whatever tasks for which they were designed. Lenses with greater smoothness and uniformity advanced the degree to which observation could be extended downward into microscopy and outward into space. Better fitting parts extended the longevity of equipment and increased efficiency by reducing internal friction. The need for increasing efficiency, precision, consistency and smoothness in lapping is as important today as ever, and each incremental increase in the quality of lapping materials and processes advances many fields of technology and industry, while at the same time offering the possibility of reducing the cost of manufacture of goods.

Lapping and polishing are performed in many fields and industries. Metal and parts polishing is the most obvious field, but smoothing of surfaces is extensively used in lens manufacture, semiconductive wafer manufacture, gem polishing, preparation of supports for optical elements, and the like. The smoothness and reproducibility of the processes and apparatus used to create the needed levels of smoothness are critical to the success of products. U.S. Pat. No. 5,584,746 (Tanaka) describes a method of polishing semiconductor wafers and apparatus therefor. The import of Tanaka is the physical control placed over the wafer as it is being polished. The wafer is secured by a vacuum system on a wafer mounting plate. The relative flexibility of the wafer is discussed as a method of controlling uniformity of the wafer surface as is the uniformity of the vacuum applied through the wafer support. The polishing of the wafer surface is accomplished by typical means including a polishing pad which is mounted on a polishing surface (turntable). It is suggested that the pad should not be subject to plastic deformation and may be preferably selected from a group comprising close cell foam (e.g., polyurethane), polyurethane impregnated polyester non-woven fabric and the like, which are known materials in the art. No specific means of securing the polishing pad to the support surface is described in Tanaka. No specific speeds of rotation for the operation of the process are shown in the examples.

U.S. Pat. No. 5,317,836 (Hasegawa) describes an apparatus for polishing chamfers of a wafer. Hasegawa describes that in the manufacture of wafer materials from single crystal ingots such as silicon, the wafer is produced by a combination or selection of processes including slicing, chamfering, lapping, etching, buffing, annealing and polishing. It is noted that chipping and/or incomplete surface polishing are a problem in such ingot conversion to wafers. Hasegawa describes the use of a rotary cylindrical buff formed with at least one annular groove in its side describing a circle normal to the axis of the cylindrical buff and a wafer holder capable of holding and turning the wafer about an axis. The improvement is described as including at least the ability of the cylindrical buff being adapted to freely shift axially, that the annular groove has a width substantially greater than the thickness of the wafer, and that the apparatus further comprises a means for axially biasing the cylindrical buff. No specific speeds of rotation for the operation of the process are shown in the examples.

U.S. Pat. No. 5,007,209 (Saito) describes an optical fiber connector polishing apparatus and method. Saito describes a method and apparatus for polishing optical fiber connectors with high accuracy. Saito indicates that the polishing is accomplished by using an elastic polishing board rotating at high speed, but no specific speed of rotation or method of attachment of the polishing board is described. Positioning pins and other controls are provided in the system to accurately align the swing fulcrum arm carrying the polishing material.

U.S. Pat. No. 4,085,549 (Hodges) describes a lens polishing machine comprising a lap tool holder and lens blank holder including independent means to provide linear and rotary movement between a lens blank and lap tool. The machine is described as useful for high speed grinding and polishing. The polishing element is gimbal mounted on its lower extreme in a spherical bearing to allow a lens blank holder to follow the contour of the lens during the polishing process. The movement between the rotary drive and linear drive mechanisms independent of each other provides a balanced and low vibration operation. No specific speeds of rotation are recited and the abrasion is provided by a slurry.

U.S. Pat. No. 4,612,733 (Lee) describes a very high speed lap with a positive lift effect. The apparatus and method comprises a rotary lapping system which uses a liquid slurry of abrasive particles. The diameters of the particles are shown to be from about 1.5 to 5 micrometers, but may be outside this range. The system is described as producing positive lift by presenting leading edge surfaces with a positive angle of attack in the liquid abrasive slurry, the leading edge surfaces generating a positive lift through hydrodynamic interaction with the slurry. Each of the positive lift tools presents a grinding surface to said workpiece when it is rotated in the slurry. There is again no specific rotational speed provided in the description, and the use of liquid slurries would cause higher lapping/abrasive areas on the exterior of the grinding/lapping face as the slurry would be at higher levels at the outside of the rotating grinding area work surface.

U.S. Pat. No. 4,709,508 (Junker) describes a method and apparatus for high speed profile grinding of rotatably clamped rotation symmetrical workpieces. Rather than the grinding element contacting the surface to be ground with a grinding surface which is rotating within a plane, the edge of the grinding element (e.g., at the circumference of a disk rather than on its face) is brought against the surface to be ground.

U.S. Pat. No. 5,197,228 describes methods and apparatus for grinding metal parts, especially with devices having a cooperative workpiece holder and a tool holder which form a grinding station. The grinder table is reciprocally moveable along an axis which is at right angle to the axis of travel of the workpiece. The grinder table may also be equipped for controlled simultaneous movement along two axes. A microprocessor is designed to send and receive signals to or from all of the moving parts of the grinding machine for moving the workpiece table towards or away from the grinding bit.

U.S. Pat. No. 4,194,324 describes a carrier for semiconductive wafers during polishing steps in their manufacture. An annular flange is present to receive pressure loading from the polishing machine during the wafer polishing operation. The holder of the polishing machine includes the ability to apply a vacuum to the carrier to maintain the carrier selectively on the polishing machine. The arrangement on the equipment allows release of the vacuum during polishing and enables simple intentional removal of the carrier. Cam follower-slot arrangements permit tilting of the mounting head.

U.S. Pat. No. 5,576,754 describes a sheet holding device for an arcuate surface with vacuum retention. The sheet and device are described as useful for internal drum plotters in imaging equipment. Vacuum pressure is applied to imaging film to keep it securely positioned within the arcuate focal plane of the imaging equipment.

U.S. Pat. No. 5,563,683 describes a substrate holder for vacuum mounting a substrate. The holder is provided with two kinds of grooves or clearances in the supporting surface. Circular support faces with multiple grooves and/or a plurality of pins to support the work are shown. The device is generally described to be useful as a holder, with such particular uses as in the manufacture of semiconductors and the support of photosensitive substrate being shown. Similarly, U.S. Pat. No. 4,943,148 describes a silicon wafer holder with at least one access port providing access to the underside of the wafer with vacuum pressure. U.S. Pat. No. 4,707,012 also describes a method of applying vacuum holding forces to a semiconductor wafer during manufacture in an improved manner. U.S. Pat. No. 4,620,738 shows the use of a vacuum pickup system for semiconductor wafers. The wafers are placed into or removed from holders by the vacuum pickup.

Similarly, U.S. Pat. No. 5,414,491 describes a vacuum holder for sheet materials comprising a plurality of arrays of vacuum channels including a plurality of vacuum plenums. Flow sensors are provided so that the system can indicate the presence and/or size of the sheets being held. Specifically described are common types of imaging materials using sheets of plain paper, photographic paper and photographic film.

U.S. Pat. No. 5,374,021 describes a vacuum holding system which is particularly useful as a vacuum table for holding articles. The holding table is particularly described with respect to the manufacture of printed circuit boards. Controlled passageways are provided which are supposed to control the application of reduced pressure and to reduce the application of the vacuum when vacuum support is not required.

U.S. Pat. No. 5,324,012 describes a holding apparatus for holding an article such as a semiconductor wafer. At least a portion of the holder contacting the wafer comprises a sintered ceramic containing certain conductive materials. The use of conductive materials and fewer pores reduces the occurrence and deposition of fine particles during use. The benefits of the materials are said to be in contributions to the cleanability of the surface, insurance of mechanical strength, reduction of weight and increased dimensional stability.

U.S. Pat. No. 5,029,555 describes a holding apparatus and method for supporting wafers during a vacuum deposition process. The apparatus is an improved system for the angled exposure of at least one surface portion of a substrate supported on a surface holder to an emission of a source impinging obliquely on the surface portion. The device moves the surface holder to improve the uniformity of the emission received on the surface portion. Wheel mechanisms are coupled together to provide maintenance capability for predetermined positions of the surface. The substrate holder is moved while its orientation to the source is carefully controlled.

U.S. Pat. Nos. 4,483,703 and 4,511,387 describe vacuum holders used to shape glass. Frames are shown with slidable members moving a deformable vacuum holder between a shaping station and a mold retraction station. Pistons drive movable elements, such as the vacuum holder, on a supporting frame.

U.S. Pat. No. 4,851,749 describes a motor driven mechanical positioner capable of moving an arm to any one of about 840 discrete angular positions. An infrared light emitting device acts with a phototransistor to control the appropriate angular position. Sensing devices also act on interdependent speed controls so as to increase the accuracy of the positioning of the arm.

U.S. Pat. No. 5,180,955 describes a positioning apparatus comprising an electromechanical system which provides controlled X-Y motion with high acceleration, high maximum speeds, and high accuracy, particularly for positioning an end-effector at predetermined locations. A high speed mini-positioner is provided comprising a positioning linkage having a changeable parallelogram structure and a base structure. A main benefit of the system is the fact that the bars and bearings of the positioner are symmetrical about the X-Y plane passing through the linkage height. The symmetry means that all actuator forces and all inertial reaction forces act in vectors lying in the plane of symmetry.

U.S. Pat. No. 5,547,330 describes an ergonomic three axis positioner. The positioner is intended to move an article along three mutually perpendicular axes through a system of interconnected slides and slide joints. Rack and pinions are also used to independently move the slides. The device is suggested for use in the visual inspection of work, particularly in the semiconductor industry.

U.S. Pat. No. 4,219,972 describes a control apparatus for a grinding machine. A revolution speeds changing means is provided which can selectively effect changes at high speeds when grinding and changes at low speeds when dressing the article. The relationship and control of the timing of the speed changes and the operations detection circuits and timers.

U.S. Pat. No. Re. 30,601 describes an apparatus and method particularly effective in the positioning of a semiconductor wafer in a preferred plane with respect to a photomask. Sensors regularly monitor the position of the wafer and a reference plane. A photoalignment system is provided in which a wafer is not physically touched by any portion of the photoalignment tool, thereby avoiding any contamination.

These systems have been described as providing benefits to particular technical and commercial fields, but they have not been shown to provide any particular benefits to truly high speed lapping/polishing systems and materials.

SUMMARY OF THE INVENTION

Lapping or polishing at high speeds with fine abrasive particles offer significant advantages in the speed of lapping, savings of time in lapping, and smoothness in the finished articles. An improved process for lapping a surface according to the present invention comprises:

using a lapper system comprising:

a) a shaft which is connected to a rotatable platen having vents for air on a front surface of said platen, said platen having a back side to which said shaft is connected and a flat front side on said platen to which can be secured an abrasive sheet by reduced air pressure conveyed through said vents;

b) a frame having a total weight of at least 200 kg supporting a work piece holder and said shaft connected to a rotatable platen;

c) a work piece holder which is movable on said frame;

c) said work piece holder is attached to a movable element on said frame which is capable of moving along said frame in a direction towards and away from said platen to perform lapping of a work piece held on said work piece holder;

d) said work piece holder having control element thereon which allow for independent movement and alignment of said work piece holder along three perpendicular axes so that a work piece on said work piece holder can be adjusted and oriented towards parallelity with said platen so that a work piece can be lapped; and e) said control elements having at least 50 settings per rotation, each setting moving said shaft along one of said three axes by a dimension less than 0.05 mm.

wherein said lapper system includes a pivoting lapper platen system comprising:

f) a shaft which is connected to a platen, said platen having a back side to which said shaft is connected and a front side on said platen to which can be secured an abrasive sheet;

g) a pivoting joint comprising a spherical or torroidal element comprising a curved outside surface, and said pivoting joint being located on the outside of said shaft, said pivoting joint having an arcuate surface area and a receding surface area of said outside surface of said pivoting joint, and said receding surface area is closest to said platen;

h) said pivoting joint having a cross section with an effective center of its area, said receding surface area of said pivoting joint being defined by a surface which has average distances from said effective center which are smaller than the average distances from said effective center to said arcuate surface area;

i) arcuate surface area of the pivoting joint is supported by at least one pair of arcuate-faced bearings, said bearings comprising at least one upper bearing and at least one lower bearing, said bearings being attached to a portion of said platen, and allowing said pivoting joint to pivot between said at least one pair of bearings;

j) said shaft being able to pivot about said pivot joint relative to said platen.

The process itself comprises a process for lapping a surface comprising:

a) providing a work piece to be lapped, having at least one surface to be lapped, b) providing a rotating platen having i) a back surface and ii) a flat surface which can be adjusted to a position parallel to said at least one surface of said work piece, said flat surface of said platen having openings therein through which air may flow, and said back surface having a pivoting joint with a shaft which rotates said platen, c) providing a sheet of abrasive material having an abrasive face and a back side, said back side being on said flat surface of said platen with the abrasive face of said sheet facing said at least one surface to be lapped, d) reducing gaseous pressure between said back side of said abrasive sheet and said flat surface of said platen to secure said sheet of abrasive material to said flat surface of said platen, and e) rotating said platen at a rotational speed of at least 500 revolutions per minute by rotating said shaft, and f) contacting said abrasive face and said at least one surface to be lapped on said work piece, and and allowing said platen to pivot around said pivot joint so that said abrasive sheet and said at least one surface to be lapped become more parallel towards each other.

Rotating of said platen is done at a rotational velocity sufficient to generate a surface speed of at least 4,000 surface feet per minute (or even more than 20,000 surface feet per minute), which, depending upon the diameter of the rotating abrasive may be at an angular speed of at least 500 revolutions per minute (which with a 15.2 cm or 6 inch diameter platen and abrasive sheet, equates to over 700 surface feet per minute at the periphery of the abrasive surface), or even more than 3,000 revolutions per minute (which with a 15.2 cm diameter abrasive sheet equates to over 4200 surface feet per minute and with a 30.4 cm or 12 inch abrasive sheet equates to over 8400 surface feet per minute) and contacting said abrasive material with said work piece. The boundary layer of any liquid (e.g., coolant or lubricant) applied to the working surface of the abrasive sheet can be controlled to improve the uniformity of the lapped surface.

BRIEF DESCRIPTION OF THE DRAWINGS

FIG. 9 is a cutaway view of a platen with a pivot connection to a rotary shaft.

FIG. 10 is a perspective view of a single Bellview spring washer.

FIG. 11 is a cutaway view of a platen with a pivot control mechanism within a shaft.

DETAILED DESCRIPTION OF THE INVENTION

Figure 1:
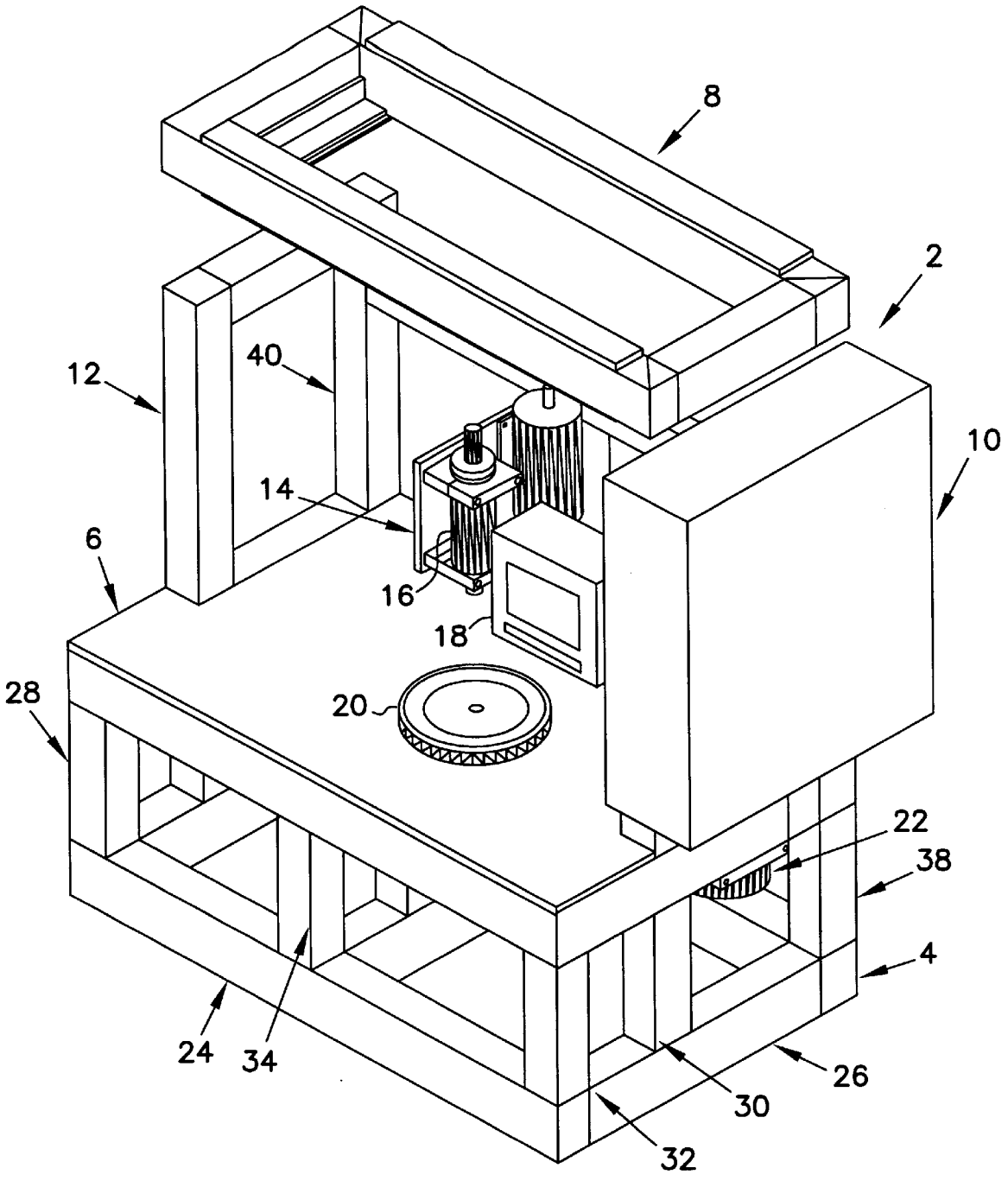
FIG. 1 is a perspective view of a lapping apparatus according to the present invention.

Apparatus and methods are needed for super high speed lapping at greater than 500 rpm, greater than 1500 rpm, higher than 2000 rpm, and even speeds of 2500, 3000 rpm and greater, equating to surface speeds at the periphery of the abrasive sheet of from about 500 to more than 25,000 rpm, depending upon the diameter of the platen and sheet as well as the angular speed. In addition, these higher speeds should be useable with finer and harder pre-made abrasive materials without the use of liquid abrasive slurries. Some earlier attempts at using liquid slurries at high rotational speeds were less effective than desired because of hydroplaning of the liquid slurries. The different forces at the different distances from the rotational center contributed to distributional difficulties in the placement of the liquid. The different amounts of liquid slurry at different radial positions caused variations in pressures and thickness at different radial points. These effects in turn caused the lapping to be less even than should be the capability of such lapping systems and materials.

The process for lapping a surface according to the present invention may comprise:

a) providing a work piece to be lapped, having at least one surface to be lapped which can be adjusted to a position parallel to said at least one surface of a rotating platen, b) providing a rotating platen having i) a back surface and ii) a flat surface, said back surface having a pivoting joint with a shaft which rotates said platen, c) providing a sheet of abrasive material having an abrasive face and a back side, said back side being on said flat surface of said platen with the abrasive face of said sheet facing said at least one surface to be lapped, d) securing said sheet of abrasive material to said flat surface of said platen, and e) rotating said platen at a rotational speed of at least 500 revolutions per minute by rotating said shaft, and f) contacting said abrasive face and said at least one surface to be lapped on said work piece, and and allowing said platen to pivot around said pivot joint so that said abrasive sheet and said at least one surface to be lapped become more parallel towards each other.

One particular advantage of the present invention is the ability of the apparatus to use preformed sheets of abrasive materials at high speeds, and to rapidly and cleanly replace the sheets without significant delays. During lapping and polishing processes, it is often necessary to change the abrasive medium at various stages. In prior art usage of sheets of abrasive materials, the individual sheets were secured to the chuck or rotating face by an adhesive. The adhesive may have been precoated on the backside of the abrasive sheet or applied as coating to the rotating support surface or the backside of the sheet immediately before use. This adhesive coating adds another parameter or variable which must be controlled in attempts to precisely lap surfaces. Even the best coating techniques provide layers which have what are presently considered minor variations in thickness in some fields of use. However, each variation, no matter how small, is part of an additive effect upon the final article. The adhesive creates another problem in that adhesives that are strong enough to secure the abrasive sheet to the platen do not necessarily remove cleanly from the platen with the removal of the sheet. Some adhesives build up on the platen surface, requiring washing or stripping to remove them, if increasing variations in non-planarity of the surface are to be avoided. This is time consuming, labor intensive, and expensive. Where the objective of the system is to provide uniform flatness, even this additional minor variable component becomes undesirable or limiting in the capability of the final article. This is particularly true where the variations can cause uneven or non-uniform exposure of abrasive material towards the workpiece, causing uneven grinding, polishing or lapping of that workpiece surface. The use of rotational abrasive action, particularly at high speeds for short duration, can quickly cause undesirable effects upon the workpiece. When pads are regularly changed with respect to their degree of coarseness in the abrasive grit, subsequent variations because of the adhesive layers will not only fail to correct the previous errors, but add further variations into the workpiece surface which were not intended. Additionally, some adhesives remain liquid or pliable (e.g., pressure-sensitive adhesives) and the centrifugal forces produced in high speed rotational abrasion can cause the adhesive to shift, flow or shear, altering the thickness of the adhesive layer even while the process is being performed.

One aspect of the present invention is to support a sheet having at least one abrasive workface and a backside on a rotating support by vacuum forces, and to perform the abrading process with the vacuum forces maintaining the contact between the support and the backside of the sheet. Although vacuum forces have been used to support or assist in the support of workpieces, the reference material described above does not describe the vacuum support of abrasive sheet materials in a high speed lapping process, nor is their any indication of the potential problem with abrasive sheet thickness variations because of the addition of adhesive coatings between the support and the sheet. The references described above, even though they may refer to high speed in production of materials, do not describe rotational speeds in excess of 1500, 2000, 2500 or even 3000 rpm, or expressed in other units, with surface speeds at the periphery of the rotatable lapping platen of at least 550, at least 1,000, more preferably at least 1500 or at least 2,000 sfpm, still more preferably at least 2,500 or 3,000 sfpm, again still more preferably at least 3,500 or 4,000 sfpm, and most preferably at least 8,000 or 10,000 or even 12,000 and more sfpm. Furthermore, it is usually the abrasive segment of the apparatus and process of that prior art which is being rotated (although as shown in U.S. Pat. No. 5,317,836, both a semiconductor wafer and the buff are rotated), while the vacuum secured workpiece remains fixed. There is no teaching in the prior art or consideration of the physical problems which could be encountered in attempting to use vacuum pressure, and particularly only vacuum pressure to support an abrasive sheet at high speed rotational lapping. For example, there is no consideration in the prior art as to whether the vacuum forces could successfully restrain movement of the abrasive sheet materials when forces (e.g., rotational) are applied to the abrasive face. The shearing forces, especially if applied unevenly on the face by non-symmetrical contact with the workpiece, could easily be envisioned to cause the abrasive sheet to shift. This would be disastrous in a lapping system and could well destroy all the earlier polishing steps performed or ruin the workpiece entirely. Although adhesives provide problems as indicated above, a change from adhesive support to vacuum support could have been considered to alter the system in unpredictable ways. As adhesives can elongate with the rotational forces, there may have been some benefit to the use of a somewhat elastic layer under the abrasive sheet, particularly in removing any waves or irregularities in the original positioning of a sheet (although this would not be technically desirable at low speed polishing or lapping since the forces would be little likely to have a significant effect). The use of a vacuum would not allow such elastic behavior in an intermediate layer, as there would be no intermediate layer. This would be another unpredictable effect in such a change from adhesive to vacuum support of an abrasive sheet material in high speed rotational lapping.

In the practice of the present invention, the abrasive sheets comprise sheets of exposed abrasive grit as a self-supporting sheet or film material. The sheets may have any type of abrasive material or surfacing on the face which is to contact the workpiece. The sheets may comprise a single layer of material (e.g., a binder with abrasive grit therein or sintered abrasive grit without any other binder) or multiple layers of materials. Such multiple layers could comprise one or more supporting layers, intermediate layers (e.g., primer layers, vibrational damping layers, electrically conductive or anti-static layers, magnetic layers, printed layers, sealer or barrier layers to prevent migration of materials between other layers), and an abrasive outer layer. The single layer, at least one layer in the combination of layers, or the interaction of the combination of layers must be able to support a vacuum against the back surface. Preferably the back surface (of the abrasive sheet) itself is non-porous or low porosity. This is desirable as too much porosity would prevent the sheet from being held against the rotatable support surface. The sheet does not have to be completely non-porous, although this is the preferred method of making the sheets used in the present invention. In addition to limiting the porosity of the sheets, the back surface should not have such a degree of topography which would allow free air flow along the back surface when it is being held against a surface by a pressure of at least 12 lb/in$^2$. If there were raised channels, ridges or the like which would allow air flow from the center of the sheet to its outer edges, the pressure would not consistently support the sheet as air would more readily leak out from the region between the support surface and the backside of the abrasive sheet.

The abrasive material may be any known abrasive material, depending upon the ultimate needs in the process for grinding, polishing or lapping a particular finished article. The abrasive particulate or raised particulate areas may comprise any solid, hard, material such as silica, titania, alumina, carborundum, boron nitride, homogeneous inorganic oxides (such as metal oxides) or blends of inorganic oxides, diamonds (natural or synthetic), or any other material which is harder than the solid surface to be polished, ground or lapped. The abrasive surface may be abrasive particles bound in a binder, either partially embedded, superficially bound to the surface, or initially embedded so that the binder must initially wear away to expose the particles. The abrasive surface may be a replicated surface structure of a pure abrasive material, an etched abrasive surface, molded surface or the like. The abrasive surface may also be deposited islands of abrasive material, with either physical (e.g., vapor deposition, screened application of powders which are fused, powder arrays which are electrostatically deposited and bonded to the surface, impact embedding of the particles) or chemical (e.g., electrochemical deposition, chemical deposition at seeded sites) of the particles in a random or ordered manner. The preferred material is an abrasive sheeting manufactured by Minnesota Mining and Manufacturing Co., known as Diamond Abrasive Disks (3M). These sheets are quite effective for the high speed, fine finish lapping processes and apparatus of the present invention. Also useful in the practice of the present invention are diamond particles contained in a metal matrix on a sheet of plastic backing material (e.g., 3M Metal Bond™ Abrasive). The only modification of the sheets which is essential for making them completely compatible with the present invention is having the sheet converted (cut) to fit the abrasion platen. The sheets may be cut into, for example, circular shapes, with or without positioning holes or a centering hole in the sheet.

The present invention may be further understood by consideration of the figures and the following description thereof. FIG. 1 shows a perspective of a basic lapping apparatus 2 according to the present invention. The apparatus 2 usually comprises at least a main support frame 4 with a vibration absorbing surface 6 which may be a single layer 6 as shown in FIG. 1 or multiple layers (not shown). The composition of the layer may be thick metal, layered metal, composite, coated metal, and the like. Two thick sheets of metal (not shown) is preferred, with one sheet fixed to the main frame 4 and the other sheet fixed to the frame top 8 at the arms 12 or which is removably attached to the first layer (not shown). There is also conveniently a frame top 8 which may be removably or permanently attached to the main frame 4. An electrical enclosure 10 is shown over the vibration absorbing surface 6. A supporting frame 14 is shown for a workpiece spindle 16. A computer 18 is also shown in the lapping apparatus 2 to provide controls over the operation. The abrasive sheet (not shown) support platen 20 is located at a position on the vibration damping surface 6 over which the workpiece spindle 16 may be positioned. Various positioning systems (later shown) which operate to keep the alignment of the workpiece spindle 16 and the abrasion support platen 20 can be preferred part of the apparatus 2. An abrasion platen drive motor 22 can be seen underneath the vibration damping surface 6. The size of the apparatus 2 is somewhat dependent upon the needs for the user. The length 24 of the base of the main frame 24 may be, for example, between about 3 to 8 feet (0.9 to 2.42 m), the width of the main frame may be, for example, between 1.5 feet and 4 feet (0.45 to 1.22 m), and the height of the main frame may be, for example, between 1.5 feet and 4 feet (0.45 to 1.22 m). Greater variations in the dimensions are of course possible, but the preferred dimensions are within this range, and especially between 4.5 feet and 5.5 feet (1.64 and 2.0 m) in length and 2 to 3 feet (0.68 and 0.91 m) in width and height. A heavy construction is preferred, with at least 0.6 cm thick steel plate in the arms 12, 30, 32, 34, 38, 40, etc. (collectively referred to as the arms 12. The arms 12 may be hollow with sheet metal of that thickness or larger, or may be solid. The dimensions of the arms 12 may be, for example, from 2 to twelve inches (5 to 31 cm) a side (assuming a square). This fairly massive composition will keep vibration to a minimum.

Figure 2:
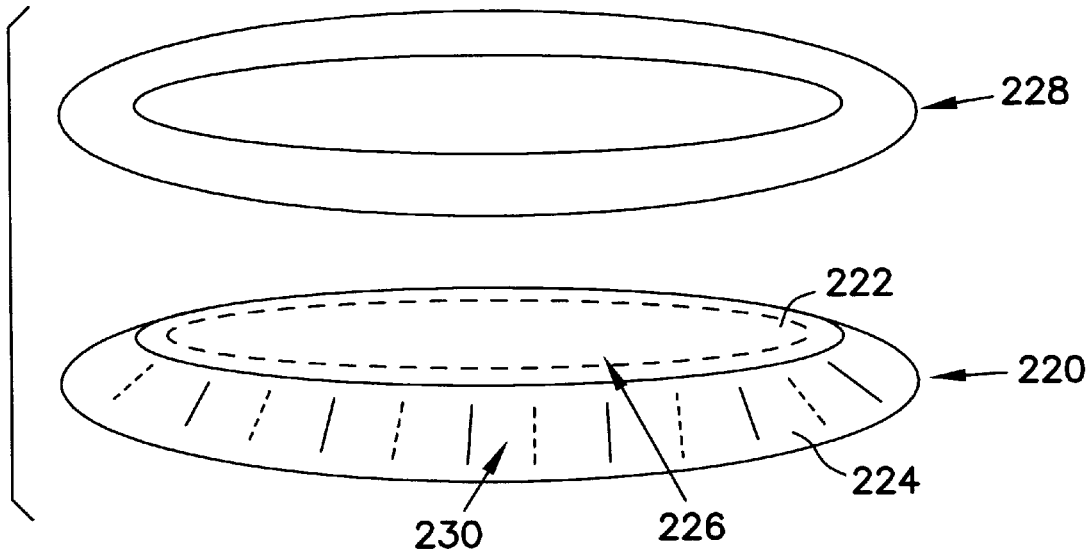
FIG. 2 is a perspective view of an annular platen with a linear edge.
Figure 3:
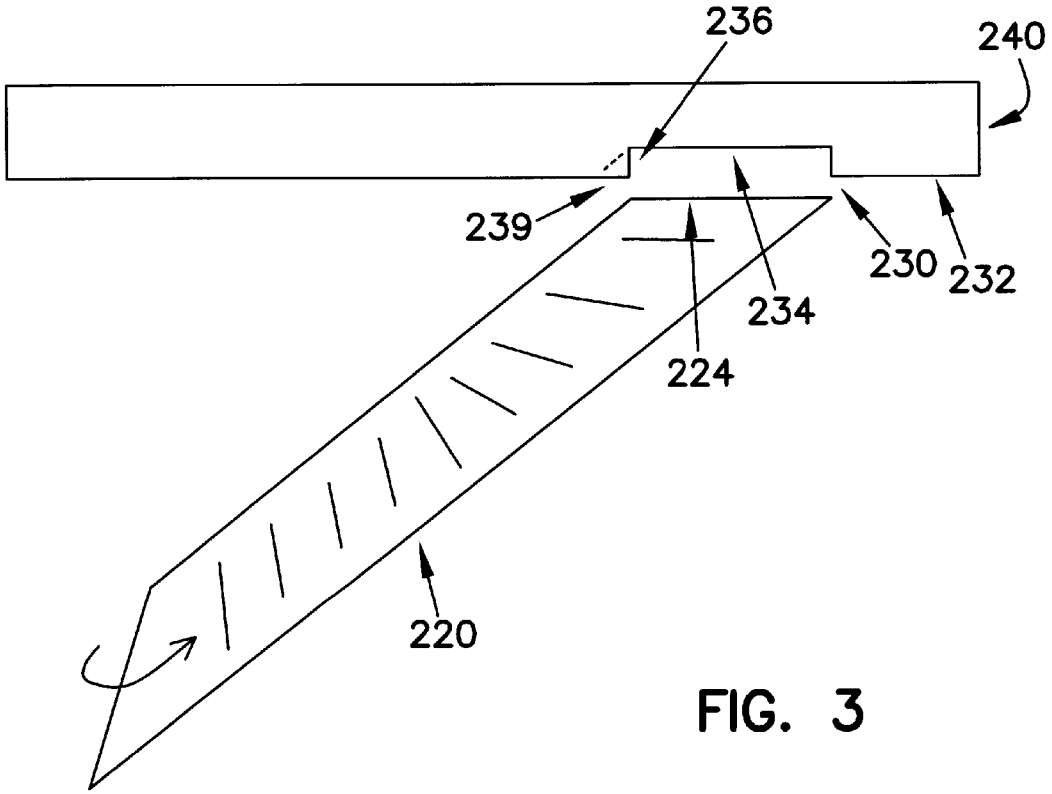
FIG. 3 is an edge view of a platen with a beveled edge and a workpiece being lapped in a linear manner by said platen.
Figure 4:
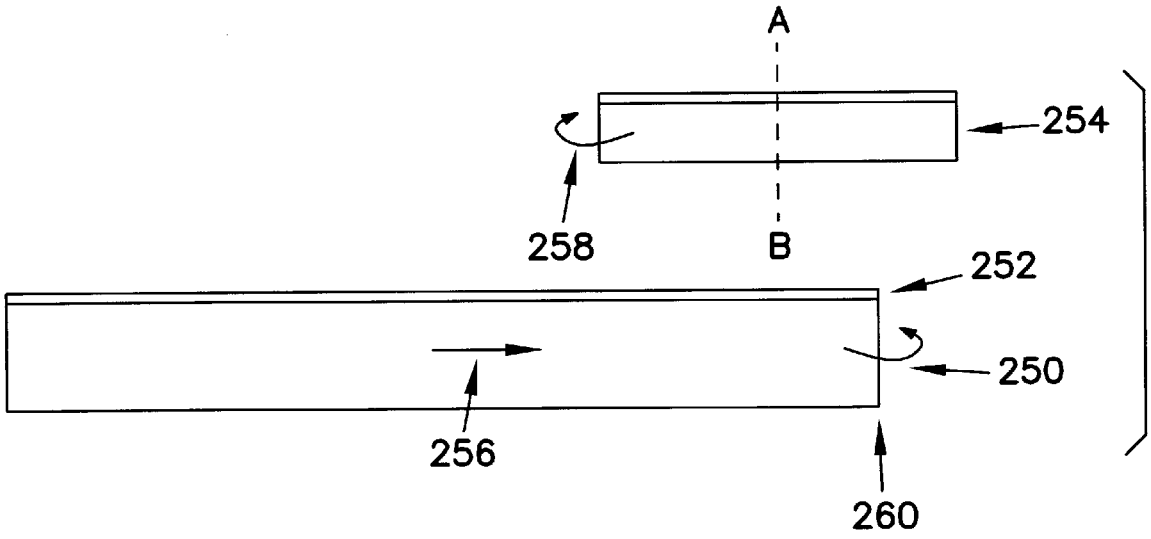
FIG. 4 is an edge view of a work piece and a platen.

FIG. 2 shows an abrasive platen 50 useful in the practice of the present invention. In the practice of the present invention, a wide range of diameters is useful for such abrasive platens 50. Typical diameters are from 7.5 to 50 cm, more preferably from 7.5 to 40 cm in diameter. The abrasive platens 50 of the invention are provided with a sufficient number of ports or holes (not numbered) to enable a vacuum to be distributed against the backside of an abrasive sheet (not shown). In FIG. 2, three circular distributions of such holes 52, 54, 56 are shown distributed as a series of holes 58. The holes 58 are a convenient, exemplary distribution, but are not essential to the practice of the present invention. Vacuum access to the backside of an abrasive sheet may be provided in many different types of distribution. The distributions do not even have to be symmetrical, but should be reasonably distributed so that sections of an abrasive pad will not lift from the platen 50 during high speed rotation while other areas are secure. There is no need to have an asymmetric distribution of holes 58, but it is a feasible construction. A circular distribution is convenient as the abrasive sheets generally used tend to be circular to fit with the circular motion of rotation and the usually circular shape of the platen 50. Other shapes may be selected, but they would tend to be prone to greater eccentricities in their motion and therefore would be less desirable. The circular set 52 of holes 58 nearer the center of the top surface 66 of the platen 50 help to secure the center portion of an abrasive pad to the platen 50. Likewise, the circular distributions 54 and 56 tend to secure an abrasive pad to the surface 66 of the platen 50 along a radius 60. The number and spacing of holes on the platen surface 66 are designed to secure an abrasive sheet without the holes (e.g., 58) being so large as to deform the sheet into the contours (not shown) of the holes. Holes on the surface are preferably less than 5 mm in diameter, more preferably less than 4 mm, still more preferably less than 3.5 or less than 3.0 mm, and most preferably greater than 0.5 mm and less than 3 mm. The minimum size and number is determined by that number and size which will support a vacuum against the backside of an abrasive sheet. A minimum size of about 0.2 mm is a reasonable starting point for commercial design. Smaller holes would clog too easily from materials produced during operation of the apparatus. More preferred would be diameters of at least 0.5 mm, more preferably at least 0.7, still more preferably at least 1.0 mm. These are average diameters, and hole sizes that differ within each circular distribution or amongst circular distributions are contemplated. Ranges of between 0.2 and 5 mm may generally be used. The circumferential edge 68 of the platen 50 may have engaging grooves or cogs 70. These cogs 70 would be used to engage with driving gears 72 and 74. A motor (not shown) would drive these driving gears 72 and 74 to rotate the abrasive platen 50.

FIG. 2 shows an approximately 32.9 cm diameter (13 inch) platen 50 with a centering post 62 which may be a removable centering post 62 inserted into a hole 64 in the surface 66 of the platen 50. In FIG. 2, the first circular distribution of holes 52 at a diameter of about 62.8 mm (2.5 inch) comprises 30 holes having diameters of about 1.5748 mm (0.062 inches). The third circular distribution of holes 56 at a diameter of about 29.2 cm comprises 180 holes of about 1.5748 mm (0.062 inches). The second circular distribution of holes 54 is at a diameter of 22.8 cm (9.0 inches). Radial, rather than circular patterns of holes may be easily placed on the surface 66 of the platen 50. Designs or other patterns, or even random distributions of holes may be placed onto the surface as long as a vacuum can be supported on the backside of an abrasive sheet.

Smoothness and flatness are two characteristics which are used in the art to measure the quality of lapping and polishing performance. Smoothness can be measured by profilometers (either, for example, confocal or stylus) and is measured in linear dimensions and standard deviations or variations from uniformity. Flatness is conventionally measured in terms of light bands, using equipment such as LAPMASTER Monochromatic Lights (e.g., Models CP-2 and CP-1) in combination with flat glass over the surface to be evaluated for flatness. The use of light band units (e.g., the number of lightbands per unit of horizontal dimension on the surface being evaluated, e.g., per inch) can measure surface flatness within millionths of an inch. Curvature of radiating lines away from a line of contact between the glass and the surface against which light is being projected would indicate a degree of convexity to the surface and lines curving towards the point of contact would indicate a degree of concavity. Straight, parallel, evenly spaced lines indicate true flatness. Normal lapping procedures of the prior art are able to achieve 1–2 lightbands of smoothness, but the process commonly takes hours, depending on the material started with. Particularly when the material is hard (e.g., tungsten carbide or special alloys), conventional lapping is performed in hours, not necessarily including the necessary cleaning time. The use of the apparatus, processes and materials of the present invention can easily achieve 4–5 lightbands of smoothness in minutes, and with apparatus and processes combining all of the improvements described in the present invention, 1–2 lightband smoothness has actually been achieved in less than an hour, including replacement of sheets at the various stages and time for normal cleaning operations. Other conventional parameters of lapping have been exceeded by practice of the technology of the present invention.

It is a standard assumption, proven consistently by reported data and analysis, that lapping with abrasives causes fracturing within the workpiece to a depth which is equal to the average diameter of the abrasive particles. That is, if the average size of particles in a slurry or coated on a sheet are 50 micrometers, the workpiece, from that operation, will show microfracturing on the lapped surface which is equal to the average diameter of the abrasive particles used to lap the surface. Each successive lapping operation (e.g., starting with 50 micron, then 10 micron, then 2 micron particles) will leave successively smaller microfractures, but each will be equivalent to the average size of the abrasive particles used in the last lapping step. By operating at speeds of at least 500 rpm (that is surface speeds of at least 1000 surface feet per minute), diminished depth of microfracturing has been reported in the practice of the present invention. By using higher surface speeds, the microfracturing continues to be reduced until microfracturing as little as 90%, 80%, 70%, 60%, and even 50% of the actual average diameter of the abrasive particles occurs in the work piece. This is an improved characteristic of the lapping effect of the present invention. No other lapping operation is known to provide less than 90% depth of microfracturing in the workpiece as compared to the average diameter of the abrasive particles used in that lapping operation. This is a definable aspect of a process according to the present invention, and may be seen in many different materials, such as in tungsten carbide, blends or alloys of metals (e.g., copper and tungsten), plastics, composites, etc. The process also tends to smooth out non-homogeneous mixtures with less gouging of material, thus leaving fewer holes or pits in the surface because lapping and polishing, rather than gouging, is being effected. Even when performing conventional lapping processes using slurries of individual abrasive particle material in liquid carrier, low speeds of 5–200 revolutions per minute (rpm) are normally used. Some processes do use higher speeds with slurries up to 2500 rom, for example, and the pressures used to hold the rotating platen face and the work piece face together are perhaps 200 pounds with a 10 cm by 10 cm work piece face. It is considered by abrasive technology researchers that a primary method of material removal from the work piece is for the individual abrasive particles to roll along between the piece part and the platen, rolling off or flattening high spots, or the abrasive particles are dragged along by the moving platen and shear off high spots. In either case, because the average normal clamping force is high, very large localized forces are concentrated against individual grains or areas of the piece part material at its surface. These localized forces are strong enough to weaken and break the bond between the grain in the piece part and the main bulk of the piece part at the grain boundary. Subsequently, the loosened grain will be forced out of its original position and leave a void, pocket or pit where it was originally located. These pits are referred to in the art as "pick-outs" and are very undesirable.

With high speed lapping according to the present invention, the normal (perpendicular) force can be generally much lower than in lower speed lapping processes, being as low as 10% of the forces normally encountered in lower speed lapping, such as only 20 pounds (8 kg) of normal force for a 10 cm by 10 cm work piece. Because this normal force is so much less, the localized forces on individual grains and abrasive particles are reduced and much less fracturing of the piece part surface and grains on the piece part surface occur. Pick-outs on the surface have been shown to be reduced by from 10 to 90% as compared to surfaces with the same flatness, so that the smoothness of surface is improved even while the good flatness is preserved. This is particularly important in the lapping of blends or composite materials where the surface to be lapped is not uniform on a molecular scale (e.g., solid state solution), but rather provides a surface with regions of different materials (e.g., particles in a matrix, dispersed metal in a matrix, etc.), and where different responses to the action of abrasive grains may be experienced in local areas of microscopic proportions. For example, where blends of metals are present 9 e.g., tungsten and copper), high speed lapping will tend to cut off both metals by impact fracture at the same level or height, providing a superior surface finish (less roughness, more smoothness).

With the very high speeds of the abrasive particles in the practice of the present invention, particularly at speeds above 10,000 surface feet per minute, as compared to 1,000 surface feet per minute, a completely different mechanism of lapping appears to occur on the smallest levels of the materials. With the higher speed lapping by particles on the abrasive sheet, the tops or high spots on the piece part surface are removed by impact fracturing in addition to involving the normal mecahnisms and effects of shearing and rolling down high spots. Removal of excess tall material by the mechanism of impact fracturing results in lower levels of disturbance to grain boundaries between grains in the piece part and reduces the number of individual grains being broken loose.

Another significant advantage of the use of the abrasive sheets at high rotational speeds according to the present invention is that wear on the platen surface itself is greatly reduced. In slurry processes, the abrasive action works equally forcefully against the platen face and can eventually wear off the surface of the platen to a degree where the platen would have to be replaced. Even though the wear would of course tend to be even, there is no functional reason to continually sacrifice or wear out the platen. Some uneven patterns of wear may develop in the platen, and these would be translated into uneven lapping of the piece part.

Other features of the lapping apparatus of the invention, problems addressed, and solutions to these problems are also described herein. They are numerically listed below.

1. FLEXIBLE PIVOT TOOL HOLDER

Problem: When grinding or lapping single or multiple piece parts held by a tool holder with a typical diameter of 4 inches held by a center post, the tool holder is slowly (or quickly) rotated as it is presented downwardly and vertically. This movement is intended to uniformly contact the work piece and an abrasive surface rotating at very high speeds of from 2000 to 3,000 rpm (this can effectively be equivalent to more than 9,000 surface feet per minute (sfpm), depending upon the diameter of the platen. During this process, it is important that the piece part holder be "flat" so that the piece parts which contact the abrasive first are not damaged. This would be the case if the holder had one edge lower than another in its presentment to the abrasive sheet. Furthermore, with high speed lapping and grinding, it has been found to be important that the piece part holder assembly be held by a ball pivot type of device located as low as possible toward the high speed abrasive surface. This is the best design found to align the total piece part assembly so all the individual parts (e.g., the platen carrying the abrasive sheet and the work pieces) are floated equally by the thin boundary layer of coolant fluid on the surface of the disk which may be less than 0.001 inch (0.0254 mm) in depth. Boundary layers do not normally remain constant as the distance from the leading edge (contact point or liquid introduction point, or radial distance on the platen). The changes in the thickness of the boundary layer cause significant variations in platen separation distances from the work piece and effective variations in penetration of the workpiece by abrasive particles on the sheet. With this type of ball or gimbal pivot, this boundary layer thickness has a tendency to remain uniform even with slight out-of-perfect-perpendicular alignment between the vertical piece part holder shaft and the high speed abrasive platen. Foreign debris can be accumulated in pivot joints and create unwanted friction.

Solution: A work holder device is created with the use of a special ball attached to a shaft which ball and shaft combination provides a pivot action close to the bottom of the work piece holder assembly. A sandwich of washers acts as a rigid base to transfer downward a polishing normal force on the vertical shaft to push the piece parts into the abrasive platen. The pivot action is restrained by encapsulating the whole assembly with room temperature vulcanizing (RTV) silicone rubber or other elastomeric resin (e.g., fluoroelastomers) which seals the unit from debris and also provides the function on an elastic restraint that self centers the disk type part holder perpendicular to the axis of the support shaft. Yet the elastic spring which centers the unit is weak enough to allow conformal pivoting of the assembly during lapping action. Thus when there is little side load present, as when lowering the piece part assembly, the unit is flat aligned. But when the assembly is subjected to a normal force, the unit is free to pivot. A piece part holder with the back stem and RTV resin was constructed and used in a piece part assembly for the SIEcon optical connector and appeared to function well.

2. ABRASIVE METAL POLISHING MACHINE

Problem: The surfaces of metal objects are polished for many reasons including for optical examination of metallurgical characteristics, to create a smooth, low-wear, tight hydraulic or fluid seal and others. Usually this polishing is done at low speed (e.g., 5–200 rpm), with rotating flat platen disk wheels of various types of construction molding aluminum, steel, plastic cloth and others. The wheel surface is very flat and the workpiece to be polished is held with controlled pressure by hand or work holder. Water or other fluid, such a lubricant or wetted abrasive particles are introduced as a slurry, or disks of fine abrasive sheets are "stuck" or bonded to the rotating wheel. This process is slow to produce a highly polished surface, and it is labor intensive if not automated. Inaccurate platen or shaft machining, loose bearings, or weak machine structure and framework may cause polishing accuracy problems.

Solution: The present invention enables very high quality polishing which can be achieved in a fraction of the conventional lapping time by using abrasive sheeting, such as 3M brand of micro abrasive disk sheets, for polishing at very high speeds of 2,000 rpm and more using disks about 8–10" in diameter. However, it is critical that the rotating platen disk run very "true" and flat at the operation, speed range to provide a mechanically stable moving surface against which the to-be polished workpiece is held stationary of a controlled normal force or pressure (against the fine particle wetted abrasive). Options also may change the pressure as a function of process time or the workpiece rotated to distribute polishing across the surface.

A unique method to provide a very "flat" and accurate stable rotations platen disk surface would be to mount the platen to a "weak" shaft which allows the rotations disk mass to seek a true "smooth" center above its first rotating natural frequency. The motor drive speed would be increased above its natural frequency, the workpiece part preserved in contact for polishers; then removed prior to reducing the disk RPM.

3. REDUCTION OF HYDROPLANING

Problem: The presence of liquid on the abrasive surface adjacent the work piece has combined with higher rotational speeds to generate significant hydroplaning of the liquid and unequal forces on the face of the abrasive sheet and the work piece at differing positions along the radial distribution from the center to the outer edge of the abrasive sheet. The liquid is often essential to control heat, friction and cleansing of waste materials, and can not be easily removed.

Solution: The greatest needs for the liquid are 1) to control friction between the abrasive surface and the work piece, 2) control the temperature of the sheet and the work piece, and 3) to wash away residue of abrasive and abraded material from the work piece. These effects do not have to be performed at the same location between the sheet and the work piece and do not need the same amount of liquid (e.g., water, lubricant, coolant, etc.) to accomplish the separate tasks. The inventor has recognized that the amount of water needed to affect friction (a surface phenomenon, and essentially two-dimensional [very thin] amounts of liquid may be effective) tends to be much less than the amount needed to control temperature (a bulk, three-dimensional phenomenon) and waste removal (a three-dimensional and mass flow process). With this recognition, it has been found that liquid may be applied to the lapping process of the present invention with controlled amounts, specified positions, and timed introduction to perform the process with reduced likelihood of hydroplaning because of reduced amounts of liquid between the abrasive (as a sheet or other form) and the work piece. This is accomplished in the following manner.

The abrasive sheet is of a sufficient size relative to the work piece that less than fifty percent (50%) of the abrasive surface will be in contact with the work piece surface during lapping. Preferably less than 40%, more preferably less than 25%, and most preferably less than 15% of the total surface area of the abrasive sheet is in contact with the work piece during lapping at any specific time. The area where the abrasive and work piece are in actual contact is called the work area. In a zone or area rotationally before the work area, water is placed on the surface of the abrasive sheet. The amount of liquid (e.g., water) provided is preferably less than 120% by volume of that amount sufficient to fill the valleys between the peaks of the raised abrasive particles (100% essentially forming a smooth, continuous layer of liquid over the abrasive material). More preferably it is less than 110%, less than 100%, but at least 30% of that filling volume of liquid. Preferably the amount is between 30% and 120%, more preferably between 40 and 115%, still more preferably between 50 and 110%, and most preferably between 90 and 105% of the volume necessary to exactly fill the valleys on the abrasive sheet so that an essentially flat film of liquid appears although surface tension between the peaks and the film may distort the appearance so that slight circular patterns may appear without dry exposure of more than 20% by number of the particles. This approximately 100% volume amount is called the "leveling amount of liquid" in the practice of the present invention.

At a zone which is rotationally before the work area, a first amount of liquid equal to 30 to 120% of the leveling amount of liquid is placed on said abrasive surface. The area where this is performed is called the wetting area. On the surface of the abrasive sheet, rotationally after the work area, a second amount of liquid is applied to said abrasive surface, said second amount being both sufficient to have the sum of said first amount and said second amount equal to at least 120% of said leveling amount of liquid, and equaling at least 30% of the leveling amount of liquid. Preferably the total of said first and second amount comprises at least 150%, more preferably at least 170% of said leveling amount. Likewise, it is preferable that the amount of said second volume is equal to or greater than at least 50% of said leveling amount, and more preferably at least 75% or at least 100% of said leveling amount. This second volume will assist in carrying or washing the total residue on the abrasive sheet (the residue abrasive and the swarf from the piece part). The second volume is applied in what is referred to as a flood area on the abrasive surface. The high rotational speeds will remove a significant amount of the liquid and total residue on the abrasive surface, but because of the high quality sought in the lapping performance of the present invention, this may not always be relied upon. To improve the removal of the liquid carrying the total of the residue, air blades (e.g., hypodermic air knives) can be positioned between the flood area and before the wetting area. The air blades, in combination with the rotational forces, will remove a very high percentage of the applied liquid and the total residue so that an essentially dry surface can be assumed to enter the wetting area. To whatever degree it is found that not all liquid is removed by the rotational forces and air knives, the first amount of liquid may be reduced so that the appropriate percentage of leveling is provided.

4. PLATEN FLATNESS GRINDING

Problem: After a high speed 3,000 rpm, 12" (30.5 cm) diameter rotating abrasive platen has been manufactured and used on a lapping machine, it does not remain perfectly flat as originally machined. A platen which has been ground or damaged by wear or impact away from a required or desired flatness is no longer effective for high precision. For example, a platen should have a deviation in flatness of less than 0.0005 inch (0.0126 mm) at the outer periphery with a need for the best performance to reach 0.0002 inch (0.00508 mm) or less than 0.0001 inch (0.00254 mm). The platen should be flatter than the variations in thickness of the rotating abrasive disk surface. The platens are ground to the above tolerances (e.g., less than 0.0126 mm variation in thickness along an entire circle within the disk surface). These measurements can be made, for example, with a profilometer or confocal microscope. The smoothness is measured by reading the variations in thickness along such circles within the disk surface. The abrasive sheet (e.g., the diamond sheeting) lays relatively flat on the surface of the platen, but is expected to have some variations in thickness of the backing material (e.g., plastic film, such as polyester) and the abrasive coating. However, it is desirable to minimize variations and prevent additive deviations from occurring. This measurement can be made by a dial indicator placed at the outside diameter and the disk rotated by hand for one revolution to measure the maximum excursion. Any deviation acts either as a "valley" where the abrasive does not contact the piece part or a "high spot" which is the only area that contacts the piece part. When the disk rotates at its normal high speed, the high spot will have a tendency to hit the piece part and set up a vibration which will reduce the smoothness of the lapping abrasive action. Localized distortions of the platen surface will also have a tendency to penetrate the boundary layer of liquid between the platen (covered with a thin sheet of diamond or other coated abrasive) and the piece part. This can produce a localized scratch or track on the piece part surface. Any surface defect on the platen structure is generally transmitted through the thin abrasive disk and produces a bump or high spot on the disk.

Solution: An existing platen can be "dressed" as a machine by bringing it up to full high speed RPM and lowering a heavy flat abrasive coated piece unit directly onto the bare rotating platen and grinding or lapping off the bumps. High spots and even full out-of-flatness surface variations can be removed by first using a coarse abrasive and progressively using finer abrasive or lapping abrasive medium. A typical first abrasive may comprise 40 micron metal-bonded diamond and a final abrasive may comprise 3 micron or less diamond or ceramic abrasive depending on if the platen surface is chrome plated, stainless or base steel. The abrasive lapper disk could be oscillated back and forth across the platen, it could be stationary or it could rotate at either slow speed or rotate at a very high speed so the tip speed of the grinding disk will provide uniform removal of platen material at the low surface speed of the inner radius of the platen. Different geometries of adhesive disks could be used. Also a piece part holder already in use for normal lapping could be used to perform this function.

5. LAPPER PLATEN SPIRAL SURFACE

Problem: When lapping or grinding at high speeds of 3,000 rpm on a 12" (30.5 cm) diameter platen producing perhaps 8,000 to 12,000 surface feet per minute (sfpm) of surface lapping speed by use of wetted plastic disks coated with thin layers of diamond or other abrasive material, it sometimes is a disadvantage to have a uniform flat disk surface in flat contact with precision piece parts. This is because the fluid boundary layer of the wetting liquid has a tendency to draw the piece part down to the flat surface of the rotating platen and create large fluid adhesion forces. These fluid adhesion forces require more force to hold piece parts used in combination with bigger motors and require the use of larger and heavier holding devices for piece parts. This may also create a lower rate of metal removal and the further disadvantage of the grinding debris being carried along between the abrasive disk and the work piece surface. This can produce scratching or other disturbances on the work piece surface.

Solution: A precision ground rotating platen can be fabricated with slightly raised spiral surfaces having different shapes and/or patterns, these shapes or patterns varying from the inside center of the platen toward the outer periphery of the platen. The spiral patterns would create land areas at the top surface of the platen of the various widths, shapes with areas between these land areas that are somewhat lower, perhaps from 0.002 inch to 0.010 inch (0.051 to 0.254 mm) or more. Then a thin plastic coated abrasive disk that is uniformly coated with precision fine abrasive (e.g., the 3M diamond abrasive sheet material cut into disk form) would be mounted onto the round platen and held in place by vacuum hold-down holes either on a raised land surface or on the lower surface area or a combination of holes in both areas. The raised land areas could be produced by manufacturing a precision platen and acid etching or photolithographically etching land area geometry configurations. When the abrasive disk is mounted on the platen, only some portions of the disk would be in contact with the piece part being ground or lapped. The boundary layer of fluid coolant would be affected by the length of the land area under the piece part, the direction the spiral, radial or circular annular land shapes or a combination of the geometries. The effects on the boundary layer thickness would be the rotation speed of the platen, as related to the vector speed, including the direction of the surface relative speed between the two, the viscosity of the fluid, and the normal force pressure of the piece part holding it to the platen. The boundary layer thickness, which would vary over the surface of the piece part, would affect how the individual particles of abrasive (normally protruding about ⅓ of their size above the binding agent) effectively abrades a workpiece from the surface of the abrasive disk. If more liquid is applied, the boundary layer would tend to be thicker and less abrasive material removal is achieved. Thus the local pattern of the surface of the abrasive contact area can be utilized for the optimum grinding action using only one portion of the abrasive disk with the non-raised section between the land areas of the abrasive allowing free passage of grinding debris. When this surface area of the abrasive is worn, the disk can be unmounted by the vacuum chuck, rotated to a "fresh" area of the abrasive, and then grinding would be continued. The disk will remain uniform and strong throughout an extended service.

6. DOUBLE DISK GRINDING

Problem: Again, the problem to be addressed is hydroplaning, which distorts positioning of the abrasive surface and the work piece relative to each other. Especially with relatively thin or flexible work pieces (e.g., work pieces thinner than 10 cm, especially thinner than 5, 2, 1, or 0.5 cm), the worst distortion of the positioning occurs because of bending or flexing of the work piece. This is because the flexible sheet may be supported on a relatively inflexible support platen.

Solution: Two rotating platens may be provided, one each on opposite faces of the piece part or work piece. The work piece is secured against movement between the two abrasive surfaces (on the two rotating platens). The two rotating platens are rotated at the same time, in the same or opposite directions, with similar amounts of liquid applied between each platen and the work piece. The disks do not have to be rotated at the same speeds, and when this is done, the volumes of liquids used need not be as similar since the respective hydroplaning forces are proportional to the speed and the volume of liquid. The relative speeds of rotation and the relative volumes of water are selected so that the hydroplaning forces are fairly similar at the opposite outer edges of the work piece. With similar forces pushing against opposite faces or sides of the work piece at similar radial distances, there is no effective flexing force applied to the work piece. The increasing forces along the radial directions of each face of the work piece will be nearly equally balanced by similarly distributed increasing forces on the opposed side of the work piece. The two forces thus cancel each other out and there would be no flexing from hydroplaning. The film of liquid between the abrasive surface and the work piece would then remain essentially the same from where it was introduced to where it exits at the periphery. The speed and volume flow of the liquid would actually decrease from the central region to the exterior region at any given point along a radial line.

7. VACUUM CHUCK HOLDER

Problem: It is difficult to quickly load piece parts onto a piece part holder for use with a high speed lapping and polishing system. Also, it is difficult to generate a flat parallel system of polishing parts where 0.001" to 0.002" (approximately 0.025 to 0.051 mm) of material is removed from a surface to make the surface smooth, perhaps with variations of no more than 4 lightbands in smoothness, while the surface remains flat and parallel. Hot melt adhesives are presently used to fix piece parts onto the piece part holder. The use of these adhesives is slow and cumbersome to apply. The residue of the adhesives are also difficult to remove, and may contaminate the precision surface of the piece part for later use. Typically, the piece part holder has a gimbaled spherical ball end to freely allow the part to move about radially to self align the piece parts (one or more) with the surface of the rotating abrasive platen.

Solution: A piece part holder can be constructed out of a heavy metal such as steel which has substantial mass very close to the surface of the abrasive disk. The piece part holder unit will be allowed to move freely with the surface by the ball-end holder. A substantial hole can be made within the ball-end device which would allow vacuum to be coupled to the piece part holder. Individual part pockets will firmly hold the flat piece parts tightly against the individual tight fitting part pockets to create and maintain a good vacuum. A thin layer of oil or grease can be applied to the piece part to seal any leakage paths. By simply removing the vacuum applied by a rotary union to the drive shaft open inside diameter, the part is released, it may then be turned over. The opposite side may then be lapped to produce a high quality surface which does not damage the already lapped side because intimate part-to-holder contact is not made, the parts being separated by the film of oil. The part pocket is still stiff enough for good polishing action.

8. ABRASIVE DISK WITH AN ANNULAR SHAPE

Problem: When using a diamond (or other fine and hard abrasive material) abrasive disk rotating at very high surface speeds of 10,000 sfpm, most of the abrasive cutting action takes place at the outer periphery of the disk. The inside area of the disk has low surface velocity and low cutting action and also low wear rates. When a piece part traverses the disk in a sweeping motion, to prevent wearing of tracks or grooves in the abrasive, there is uneven wear at the outer and inner surfaces of the disk. There is typically a small ¼, ½, or ⅝" (0.626, 1.27, or 1.58 cm) diameter hole at the inside of the disk. The hole is usually centered to act as a positioning means to fix the abrasive disk at the center of the platen to obtain good balance for the very high speed system. A larger diameter round section could be removed from a disk to create an annular ring of acting abrasive material somewhat larger than the piece part. This would eliminate the inactive (and raised) uneven section but then the centering registration hole for positioning the disk is lost.

Solution: A disk can be fabricated with abrasive coated or exposed on the entire surface of the disk. The inside section of the abrasive disk, toward the center of the disk, could be removed by grinding or peeling off the abrasive, leaving the backing material intact with a raised section of the abrasive in an annular outer ring. The raised area is only where the abrasive is raised above the surface of the carrier (by the coating thickness). The disk backing material is usually plastic sheet, which may be reinforced. Another way to construct an annular ring would be to punch out a center disk section (e.g., a disk of 2 to 6 inches, 5.1 to 15.3 cm) of the disk for separate use and then use a centering plug (e.g., a 5.1 to 15.3 cm thinner disk) with a small locating hole. The plug could be centered on a platen center post and the annular disk centered on the plug. When the disk or annular ring plus disk is fixed into place by the vacuum grip platen, the plug is or may be removed to enable complete freedom of movement of piece parts over an annular disk. This complete movement can be effected since the centering post may also be removed after the annular disk has been positioned and secured by the vacuum. The process of using an annular disk element can be effected where the round sheet has an outer edge and an inner edge defining a cut-out portion and comprises an annular sheet, said inner edge having a diameter which is greater than one-third the diameter of said outer edge. The process may also be performed where said sheet is round and said round sheet has an outer edge and an inner edge defining a cut-out portion and comprises an annular sheet, said inner edge having a diameter which is greater than one-third the diameter of said outer edge.

9. VACUUM ADHESIVE HOLD-DOWN

Problem: When lapping or polishing at very high surface speed of about 10,000 surface feet per minute, it is difficult to mount piece parts onto a rotating holder. The piece part holders are used for contacting an abrasive disk mounted or constructed on a rotating platen. The parts must be held in a sufficiently rigid manner that they are not broken loose from their mount. It is also desirable to avoid a localized vibration of the typically thin flat piece part (which vibration is induced by the high speed contact with the rotating platen). Vibrations can cause patterns of uneven polishing on the surface of the precision part. It is desirable for efficiency that one or more piece parts are processed at the same time and that both mounting and unloading of these parts can be done quickly and easily to provide cost effective polishing rates of production. Furthermore, it is desirable to have a method of changing parts quickly so that one side be lapped, that part turned over and the second flat side be lapped to be very parallel to the first side. This must be done when typically 0.001" to 0.002" or less is removed from each side.

Solution: Thin piece parts of about 1"×2"×0.080" (2.54×5.08×0.23 cm) can be mounted onto an individual piece of pressure sensitive adhesive (PSA) tape and this taped piece part can then be held by a vacuum to a workpiece holder. The friction properties of the non-adhesive side of the tape would be controlled by selection of tape backing material or by surface conditioning of the backside of the tape to provide a sufficiently high degree of friction which would resist lateral dynamic forces in a plane along the surface of the thin workpiece as the nominal 14 pounds per square inch (psi's, 25 inches Hg vacuum, 6635 mm Hg) would apply a normal force holding the work piece. A large section of adhesive tape could be used to hold a number of workpieces at the same time. This would allow fast and easy installation of the workpieces by hand or robot. This flexible assembly of pressure sensitive adhesive (PS) secured workpieces could than be held in position against a precision flat surface of a workpiece holder having random vacuum holes over its surface which would all be sealed by the wide and complete expanse of tape covering the vacuum holes and at the same time firmly holding the individual workpieces to the holder. To process the other side, the group of workpieces would be removed, new tape would be applied to the lapped surface side, and the tape on the unprocessed side would be easily peeled off. The tape would not only fix the parts to the holder surface, but also would protect the precision lapped side from any scuffing action or rubbing on the holder.

10. SPRING-CENTERED WORKPIECE HOLDER—COILED VACUUM HOSE

Problem: When holding piece parts on a rotating holder in contact with a rotating abrasive coated platen rotating at a surface speed of 10,000 feet per minute, it is difficult to create a gimbaled, free wobble motion which allows the contacting surface to be continuously aligned by itself to the flatness of the rotating platen, while at the same time the contacting surface of the piece part is held stiffly enough in a nominally flat position. This is particularly true when first lowering the workpiece holder to the abrasive surface while rotating the workpiece so as not to have one corner of a workpiece contact the abrasive before other corners or surfaces. This would cause the corner to be preferentially abraded away, thereby producing an uneven workpiece surface. Vacuum piece part clamping hoses could also create problem forces.

Solution: A coiled spring can be used to apply a self correcting force between the work piece holder plate having a gimbaled spherical bearing and the rotating drive shaft of the rotating piece part holder. This spring could be made of metal or plastic material which would allow the straightening action to be applied but also would introduce vibration damping for excitation vibrations set up by the high speed, contact abrasive action. One or more solid plastic coupling bars could provide damped spring action. Also, if a vacuum hose were to be used to provide vacuum clamping of the piece part to the piece part holder through a hollow drive shaft, this type of hose could extend from the shaft and be coiled to provide a spring support action (with perhaps less than one complete turn, one complete turn or multiple turns which nominally lay flat with the upper surface of the work piece holder, which would minimize the creation of uneven "normal" turns).

11. ANGLED OR BEVELED SURFACE ABRASION

Problem: Many of the problems herein discussed for lapping with the flat surface of a platen are also encountered with beveled edge lapping, where the edges of a platen are beveled, and abrasive is on the face of the bevel. That abrasive face is then used to lap or grind another surface.

Solution: There are two fundamental ways of addressing this issue. Both involve the use of an annular abrasive sheet. The sheet has an outer edge and an inner edge (within the hole). The annular sheet should be placed on a platen, which is either flat, the outer periphery bent, or beveled. The outer edge should not extend significantly beyond the outer edge of the bevel or platen (e.g., less than 1 mm, more preferably less than 0.5 mm, still more preferably less than 0.1 mm). The inner edge should in likewise dimensions likewise not extend beyond the interior edge of the bevel or the bend. If the annular disk is positioned on a flat platen, the flat platen may be bent substantially (with the same or like dimension tolerances) at the interior edge of the annular disk to form the lapping abrasive edge on the platen. The only caution which must be exercised is to assure than no folds or wrinkles appear in the annular disk. A preformed annular disk (as with a conical segment with the inner hole diameter located above the exterior hole diameter.

The annular disk may be secured by adhesive, but the vacuum securement of the present invention is preferred.

12. ABRASIVE LAPPER

Problem: Operation of the high speed lapping devices envisioned by the present invention are at revolutionary or rotational speeds of at least 500 rpm, or at least 1,500 rpm, and preferably at 2,000 to 3,000 RPM with a fine abrasive sheet, such as the preferred 3M diamond coated abrasive disk of about 12" (30.5 cm) diameter. These sheets are normally held to a steel rotating platen by water film surface tension and positioned by a ½" (1.27 cm) diameter hole at the center of the disks. These positioning holes were used with a ½" (1.27 cm) diameter post at the center of the platen. When such a rotational speed of operation was attempted with the disk secured by water film tension, the disk lost its surface tension adhesion and was thrown off the platen while polishing a tungsten carbide piece part. The forces on the disk were such as to lift it off the ½" (1.27 cm) centering post and the whole disk was thrown off to the side of the machine opening cavity at the top of the machine post.

Solution The ½" (1.27 cm) centering post could be made larger in diameter to perhaps 1" (2.54 cm) diameter or more. Also, the post could have a hexagonal shape or an oval shape which would prevent the disk from rotating relative to the tangential surface of the disk by having the apices of the hexagons (or other polygon) resist rotation against a similar cut hole in the sheet or disk. The post could also be made higher so the chance of the self-destructing disk climbing up the height of the post would be diminished during this type of event. Another technique would be to employ a clamp type of device to any of these round or non-round posts to clamp/hold the disk firmly to the surface of the platen at the center areas of the disk which is not used for polishing. This clamping force would be effective because of the slow lineal velocity in that sector. The clamp could consist of a spring locked washer pressed on the disk surface with a thread nut engaged with a top threaded post. Springs could also be used to control the amount of force and to evenly spread the force uniformly. Ball insert or other snap latch fixing devices could also be employed.

13. ABRASIVE LAPPER

Problem: Using round disks of minute particle coated sheets (e.g., abrasive particle sheets and especially hard abrasive particles such as diamonds) of plastic film on 1,500, 2,000 or even 3,000 RPM spinning platens provides significant difficulties. It is particularly difficult to hold the abrasive sheet in contact with the platen when the lapping apparatus is operating in contact with stationary or semi-stationary workpieces. When an abrasive disk becomes loose by breaking the conventional water filter "adhesive" surface tension between the disk and the platen, the abrasive sheet has a tendency to rip or bunch-up and wedge between the workpiece holder and the high inertia spinning platen and can easily damage a workpiece part or can destroy portions of the workpiece assembly with the possibility of great danger to the operator. This is a unique problem due to the very high rotational speeds of 1,500, 3,000 or even greater RPM with a platen of 15" (38.1 cm) diameter or more constructed of heavy steel which could generate explosive type failures or at least high velocity projectile failure. As this equipment is operated horizontally for the most part, the whole surrounding area around the machine is susceptible to this danger. A previous attempt by applicants to reduce the likelihood of this type of separation problem was to coat one side of the diamond abrasive disk with a PSA, pressure sensitive adhesive film to temporarily bond the disk to the platen. This adhesive created a flatness accuracy problem in that its normal thickness accuracy varied greatly around the disk which causes high areas of lapping contact for this super precision abrasive contact. Secondly, when a disk was removed, some sectors or pieces of transparent PSA adhesive remained in the platen and formed a bump when the next abrasive disk was installed on the platen. This then destroyed the smooth vibration free abrasive lappings at high speeds.

Solution: Use a diamond or other abrasive disks without using PSA adhesive and first position the disk at the true center of the platen by use of a center hole in the disk positioned over a post positioned at the center of the platen (or by other centering means) and then by holding the abrasive disk to the platen by use of vacuum by use of a rotating union on the hollow rotating platen shaft. The preferred area to apply the vacuum would be at the inner radius of the disk which would seal out air first as the disk is installed at the platen center. Because this inner one-fourth or so of radius is not used as much for lapping because of the slow surface lapping velocity, there would be less direct forces applied at this portion of the disk. The second most preferred vacuum area (e.g., the outermost edge region of the disk) would also not be used much and would have large holding force.

14. SUPER HIGH SPEED LAPPER

Problem: It is difficult to quickly lap hand metal or ceramic or other materials with conventional lapping techniques using disk platens which are 12" (30.5 cm) to 43" (109 cm) in diameter operating at 200 to 300 RPM using loose abrasive paste media. The amount of time used contributes to cost and time delays. Larger diameter platens are potentially dangerous at high speeds and paste could be used in extremely large amounts as it would be difficult to retain on the platen surface.

Solution: A high speed lapping system can be a sheet of abrasive material such as fixed diamond abrasive coated or plated on a disk sheet of material. These sheets or disks may be used on a rotating platen disk with a diameter of, for example, 12" (30.5 cm). When operating at 500, 1,500, 2,000 or 3,000 RPM, the apparatus gives a surface speed of about 9,000 to 20,000 feet per minute. If a larger diameter platen wheel of 15" inches is used, the RPM can be lowered somewhat to perhaps 2,500 RPM to achieve the same 10,000 (or 9,000) feet per minute (fpm). Similarly, if the wheel diameter of the platen is 18" diameter, then the speed can be further reduced to produce 9,000–10,000 fpm at the outer periphery of the disk. Any reduction of angular or rotational speed created by larger diameters is desirable because of the particular danger of a high inertia wheel creating problems if a disk or part is damaged or comes loose. The higher speeds used in the practice of the present invention, plus the controls shown for maintaining accurate address between the abrasive surface and the workpiece allows for much faster and therefore more economic lapping. Work that previously took hours, including intermediate cleanup steps, can be performed in minutes using the apparatus and methods of the present invention.

15. WATER FLOW RATE

Problem: The surface finish smoothness and flatness of hard parts made of metal or ceramic or other materials vary as a function of the work force on the piece part as the workpiece is held against the surface of a high speed 9,000 to 10,000 fpm abrasive lapping action. Unexplained variations in the quality and accuracy of the lapping action were observed.

Solution: It was found that the amount of coolant, lubricating water or liquid applied to the surface of the high speed rotating disk affects the quality of the lapping action. If a reduced flow rate of water is applied, the abrasive cutting rate is increased as the relative dimensions of the boundary layer and the total liquid thickness and dimensions between the base of the abrasive disk and the piece part are increased. This increase in the relative dimensions of the boundary layer and the decreasing of the separation of the abrasive disk and the piece part by the liquid allows the exposed diamond particles to be more active in removing material as they penetrate deeper into the surface of the material. Also, if the water flow rate is reduced and the piece part is more "flooded", then a thicker boundary layer of water or liquid builds up between the part and the surface of the disk and the piece part. This keeps the (e.g., diamond) abrasive particles away from the piece part and allows some fraction of their normal penetration which results in a smoother and flatter surface on the part. One method of utilizing this performance is to have reduced water flow at the first portion of the lapping period for more aggressive material removal with an increased roughness of the surface. Subsequently the water flow is increased somewhat during the middle portion of the abrasive cycle to get better surface finish and yet have a medium material removal rate and then to substantially increase the water flow rate at the end of the cycle to produce a very smooth and flat surface with a low rate of material removal. This could be easily done with an automatic water flow rate control system. This would change the water flow rate automatically at various stages in the abrasive cycle.

The liquid (especially water) introduced as a lubricant between the platen and the work piece is normally filtered to eliminate particles which are 1 micron or larger in their largest dimension. The use of a positive displacement pump such as a gear pump or piston pump can be helpful in determining the optimum quantities of flow and charge during operation of the system, at the beginning, middle and end of opertaion of the lapping cycle.

16. SAFETY BOX FOR PLATEN

Problem: When performing abrasive lapping at high surface speeds of 9–10,000 fpm on round platens rotating at 3,000 RPM with diameters of 12", 15" and 18", there is substantial danger when a piece part is broken off its holder (as it normally is held with a weaker adhesive or mounting system) and the piece part being thrown off the platen or getting stuck on the platen and ripping the diamond or other abrasive disk causing further possibility of fast destruction of parts of the machine with parts thrown out and endangering an operator or others or equipment due to large kinetic energy contained in the rotating disk.

Solution: The rotating platen is round in shape with about a 12" or 15" (30.5 cm to 43.5 cm) diameter. A box is constructed which is rectangular in shape with "square" corners (4 each) and with the walls some distance away from the round platen, typically 6" or more. Also the box is desirable to be constructed of a soft plastic (or rubber) such as ½" thick high density polyethylene which would tend to absorb impact from a heavy metal free flying, broken loose part without ricocheting the part back into contact with the rotating disk which prevents it from being thrown against the part and damaging the part. Also, the "square" corners provide a remote area to try the part and to contain the part as it stopped moving by being impacted in one or more metal walls. Having a distance between the flat walls and the rotating disk which is somewhat larger than the largest size of the piece part, centrifugal force would tend to drive the part off the disk radially and allowing it to roll or move tangentially to a neutral corner of the box away from the disk. At the same way, crumpled abrasive disks are collected by the neutral open corners. Having a ledge over the inside portion of the box also helps trap the parts.

The use of a safety box with at least 10% (of the diameter of the platen) clearance on each side of the platen within the safety box area is quite effective. It is more preferred to have the safety box with a clearance of 20%, 30% or even more than 50% of the diameter of the platen (on each side of the platen within the box or at least from at least one side of the platen) in the practice of this aspect of the invention. It is particularly desirable to have the platen moving assembly lift the platen out of the safety box so that the box may be cleaned without contacting the platen. A removable bottom section may be constructed on the box for bottom cleaning without having to significantly move the platen, but any openings or movable pieces may add to vibration potential in the system and is therefore not the most desirable engineering approach to the construction of the safety box.

The box may have a high center section and be angled or curved in the outer section so that any loose parts or pieces would tend to drop below the rotating platen and not be picked up by the platen and projected back toward the opening in an area above the abrasive surface of the platen (e.g., towards the operator). As liquids are used in the lapping action, a tapered bottom of the safety box area toward one or more drain holes allows the expended liquid (and any carried particulates) to be easily collected for disposal, even without opening of the safety box area. The angle of the box bottom to obtain the best flow conditions for the liquid will be selected to providea washing action on the surface to minimize buildup of ground particles on the surface of the bottom of the safety box. Grooves to concentrate water flow or passage may also be provided.

A temporary cover may be provided over the opening of the platen top access hole to provide additional safety to the operator from projectiles and also to contain any mist formed by the high speed shearing and projection of liquids. Duct work can also be installed in the box to withdraw air born vapor and particles as well as the liquids, with reduced pressure removing the undesirable materials at a controlled rate. Filter elements may also be associated with these removal systems.

17. COUNTERWEIGHT WORKPIECE HOLDER

Problem: When a workpiece holder is held down by an air cylinder to provide normal force on a workpiece against a high speed 10,000 fpm rotating disk by moving vertically up and down to load parts and lap. Then there is potential great danger if air pressure is lost due to air line leaks or electrical failure. If this load of the disk rotating motor assembly which may weigh 30 lbs. (13.6 kg), drops on the 12" (30.5 cm) heavy rotating disk operating at 3,000 RPM, there is great danger in that the abrasive disk can be torn or cut, jam up and create danger to the operator or severely damage piece parts which may have great value.

Solution: The vertically moving piece part assembly can be mounted on vertical slide and a chain or cable used with a counterweight which is perhaps 10 lbs. (4.54 kg) heavier than the 30 lb. (13.6 kg) assembly. Upon loss of electrical power which would interrupt power to the normally used suspension air cylinder or a line leak to the cylinder, the piece part assembly would simply and quickly retract to the upper position, taking it out of contact with the rotating platen and thereby reducing the chance of danger. This could also be a more assured event by using an e-stop (emergency-stop) action switch which would not require power to obtain safe action.

18. SECUREMENT OF WORKPIECES TO A SUPPORT

Problem When lapping parts, it is typically quite difficult to hold the lapped parts in a fixture so that they are flat and parallel when presented to and in contact and when removed from the lapping platen wheel particularly when the platen is rotating at high speeds of 3,000 rpm as compared to 200 rpm, of a part is fixed by mechanism clamping it is subject to be loose or complaint and patterns or lack of highly accurate surface finish such as (4) four light bands is not attained. It is also difficult to quickly and accurately load and unload parts. Also, the surface finish at the part holder on the mounting sill may disrupt or destroy the surface already polished when lapping the other side.

Solution: Functional mechanical parts, which are typically 1 to 2 inches (2.54 to 5.08 cm) in diameter (or shaped other than circular cross-section, such as rectangular) which may be thin (0.010 inch, 0.254 mm) or thick (0.500 inch, 12.7 mm) can be affixed to a precision flat steel, other metal or other material plate by use of paraffin wax as a bonding agent. Here the plate or part can be coated with wax or the wax simply melted on the plate between the part and plate and the part placed on the plate, heat applied, and the two pieces would have a fully wetted surface of molten wax. The parts could be positioned by mechanical or other means of uniform pressure or force so that they lay flat with a uniform and controlled thickness of molten wax. Upon cooling the part/plate assembly, the parts would be positioned accurately and firmly for the plate read for lapping action then the plate could be attached to a piece part holding device by use of a vacuum chuck or by use of a magnetic chuck if the plate were, for example, steel. The piece part holder could have a ball type pivot close to the lapping action surface. Plates could hold one or many individual parts. Upon lapping one side, the plate/part assembly could be heated, the parts removed and if desired the parts could be reassembled with heated wax on a plate with precise parallel alignment with no danger of damage to the lapped surface because of separation from the plate with no wax. And this way many plates could be preassembled for high production rates with a single lapper.

19. OSCILLATING WORKPIECE LINKING SYSTEM

Problem: It is desirable to have a simple drive mechanism to position a stationary or rotating workpiece on the outer periphery of a high speed rotating (3000 rpm) abrasive disk so that for most of the processing time there is a small portion of the polishing or lapping time spent at the inner radius portion of the abrasive disk where the surface speed is reduced and the abrasive action is reduced.

Solution: A simple, eccentric harmonic motion, constant speed rotation can be provided by a DC or AC gear motor hub used to drive a linkage system. This system will provide a smooth continuous motion at a workpiece with most of the time in a given hub rotation cycle being spent with the workpiece operating at the outer periphery of the abrasive disk which has the highest surface speed and also grinding action. Only a very small portion of the cycle time would be spent at the inner radius, low surface speed and reduced grinding action portion of the disk.

20. SUPPORT OF SMALL WORKPIECES

Problem: It is difficult to hold small hard parts which are thin (typical size: 1"×1"×⅛", 2.54×2.54×0.318 cm) in such a fashion that surfaces (usually two) with flat features can be polished with a lapping action by a high speed (e.g., as high as 3000 rpm) rotating disk with a preferably diamond abrasive disk exerting substantial lateral force by the moving platen powered by a (e.g., 2 HP) motor for a 12" (30.5 cm) diameter disk when subjected to about 10 (4.55 kg) pounds at normal clamping force when subjected to surface water spray.

Solution: These small parts can be affixed to a flat surfaced piece part holder or a holder which has small shallow pockets just larger than the length and width of the flat part so that an exposed surface of the part protrudes away from the holder. This will allow the abrasive disk polishing action to be applied to the piece part and not to the holder. A medium temperature wax, or other easily removable adherent material can be melted and used to bond a rough surfaced part to the flat smooth surfaced part holder plate. The flat plate in turn can be attached to a rotating pivoting arm which is swept across a portion of the surface of the high speed rotating disk until a smooth flat polished lapped surface is generated on one side of the piece part. Then the part holder plate which would have 1 or 2 or many more parts attached to it in a fixed mounting pattern could be brought into contact with another mounting plate having a flat surface or a shallow pocketed surface pattern which matches the first part plate. A higher temperature wax (higher temperature than the first wax) could be melted at the surface of the parts already lapped and as they were held in flat contact with the new plate, the original lower melting point wax would release the parts from the first plate and upon cooling somewhat. The parts would be transferred as a group to the second plate ready to have the rough remaining side lapped as the first plate is readily removed. High production rates at lapping flat parts on both sides with good parallelism could be achieved.

21. BOUNDARY LAYER CONTROL

Problem: When high speed lapping a 3000 rpm rotating flat platen with fixed abrasives attached to the platen with adhesives or vacuum, water on the rotating platen abrasive surface forms a boundary layer between the work piece and the abrasive media. The boundary layer thickness and shape effect the flatness of the work piece. The work piece must be allowed to "float" on the boundary layer. This is done with a gimbal mechanism which puts pressure down on the rotating workpiece. It also allows the work piece to "gimbal" in the horizontal plane while an independent driver pin drives the work piece around the center line of the work holder shaft. The amount of down pressure also effects the boundary layer. The work piece floating on the boundary layer of water allows the abrasive media and the platen imperfections to be averaged out-high spots on the abrasive do the lapping while the low spots are filled with water allowing the lapping action to take place and produce a finished part (work piece) that is flatter than the media and platen. The work piece will only be as flat as the boundary layer. The problem is how to control the boundary layer thickness and shape on a work piece with a small surface area that is not large enough to float on the boundary layer with a minimum amount of down pressure.

Solution: Pump water through the work holder and into controlled orifices or jets in strategic locations that would force a boundary layer to form between the work piece and the abrasive media. The water would also stabilize the workpiece while presenting it to the rotating platen initially and while lifting the work piece off after lapping is complete. Water is injected or otherwise directed to an inside radial area of a piece part holder which is holding a number of discrete piece parts at the same time. This could be particularly helpful when an annular distribution of abrasive is used. In this aspect of the invention, the inside portion of the water would develop a second boundary layer under the trailing portion of the piece part holder which contains a second piece part in contact with the narrow annular band of abrasive. Boundary layer water enetering under the leading edge of the holder would tend to lift up that first piece part and tend to tilt the second piece part downward. This would cause a ground cone shape to form on the piece part a second bondary layer would also develop under the second piece part at the trailing site of the holder and lift it upward, which would compensate for the tilting of the first piece part. Collectively, the whole piecepart assembly would tend to lay flat as it would be supported by both boundary layers at the same time. There would be little tilting of the piece part toward or away from the platen rotational center as the parts are in contact with the (e.g., narrow) annular band of abrasive which would only effect a narrow strip of grinding action. That is, the introduction of liquid between the piece parts (along an arc [having the center of the platen as its center] connecting both piece parts which are in contact with the annular abrasive areas), reduces any tilting action which might normally occur because if hydroplaning or boundary layer effects from a liquid is introduced at the relative center of the abrasive sheet only.

22. BOUNDARY LAYER PROBLEMS WITH SMALL PIECE PARTS

Problem: When lapping or grinding a multiple number of small parts or single small parts each having small surface areas and short surface dimensions in the approximate size of 6.25 mil by 0.25 mil and these parts are positioned in contact with a high speed rotating disk operating at 3000 rpm for perhaps 9000 sfpm speed, there is not enough surface length to the part to build up a sufficient boundary layer to float or support the part as it is making contact with the abrasive disk on the high speed platen. The parts tend to dig into the abrasive disk and tear the disk and prevent accurate polishing or lapping of the part.

Solution: Providing a system where an adequate boundary layer can be generated and maintained while the individual piece parts are being lapped can easily be done by adding a secondary device to the piece part holder device which would have sufficient surface area, dimensions and flow to develop the boundary layer. The secondary device is also ground down simultaneously with the piece parts in a sacrificial way. A typical shape of this can be a disk of metal such as brass which would be mounted on the inside annular position of a tool piece holder with the to-be-lapped piece parts mounted outboard of these on the periphery of a round piece part holder. As the total exposed surface area is ground down, the piece parts are held suspended above the high speed moving abrasive by the large surface area of the sacrificial disk. A typical disk would be 4 inches (10.2 cm) outside diameter, 2 inches (5.08 cm) inside diameter and about 0.60 inches (1.52 cm) Thick. It could be easily attached with vacuum chucking and/or adhesive tape and could be used over and over by loading new piece parts with a partially ground disk. Other geometry sacrificial plates could be used and combinations of materials including other metals such as steel or ceramics.

23. CONTINUOUS SHEET WITH ANNULAR DISTRIBUTION OF ABRASIVE

Problem: The annular sheet provides significant advantages to the performance of many aspects of the present invention, but as with advance, other issues may develop in performance. Where annular sheets are cut from sheets and applied to a flat face of a platen, particulate grit and abraded material and/or liquid lubricant can work its way under the edge of the annular section. Even in the small time periods when the sheet is in use, which may be as short as ten to fifteen seconds, some particles may lift an edge of the sheet and cause problems with the uniformity of the lay annular sheet. This would cause undesirable effects on the lapping process and quality. Additionally, at extremely high speeds, the annular section becomes wobbly, does not sit properly on the platen, may be difficult to lay down accurately, and provide other structural difficulties in securing the annular sheet to the platen.

Solution: There are a number of ways in which a continuous sheet of abrasive material may be provided, including a flat sheet having an annular distribution of abrasive material and a continuous middle section without abrasive thereon. The most expensive way of providing such a sheet would be to coat the abrasive out in an annular distribution, as by roller coating, gravure coating or screen coating of the abrasive and binder. An adhesive binder may be printed onto the backing and the surface dusted with the abrasive grit to form an annular distribution on a continuous sheet. This type of process would again require a new coating step rather than providing a means for using existing sheet material. Another less preferred method of providing an annular distribution of abrasive with a continuous sheet between the inner diameter of the annular distribution would be to cut a circular element out of the abrasive sheet material and then abrade away an interior section of only the abrasive particles (leaving the backing materail) to create an annular element. This would be a waste of significant amounts of abrasive surface area, but would provide a useful annular sheet on a continuous backing.

The most preferred method according to the present invention is to cut out an annular ring of material of the dimensions that are desired and then fixing or securing a non-abrasive sheet material (hereinafter referred to as the center portion) within the cut-out portion of the annulus. In providing such a construction, the following concepts should be kept in mind. The joint between the annular sheet portion and the center portion should not extend above the average height of the abrasive particles with respect to the backing material. This can be done in a number of ways. A thinner sheet material than the backing material may be used for the center portion. This center portion does not have to provide any significant structural component to the annular ring, but it can provide advantages as noted later if the center portion is relatively stiff and strong (even stiffer and stronger than the annular sheet material section). The presence of such material, stiffened or not, does tend to make the ring easier to work with, avoids wrinkling, and makes the abrasive sheet easier to lay down on the annular work zone. The center portion clearly provides a stabilizing influence on the sheet as it is being applied to the platen. The material for the center portion may be chosen from a wide range of materials because of the minimum physical and/or chemical requirements for the material. Plastic film or paper is the easiest materials to provide for the center portion. There may be a centering hole in the middle of the center portion, or even a larger hole than is needed for centering. The larger hole adds no significant structural advantage, and should not minimize the stabilizing or edge protecting effect of the center portion, but some latitude is available in the dimensions of the center portion with respect to the entire size of the annulus without preventing some of the benefits of the present invention.

The center portion may be secured to the annular ring by any process which adheres the center portion to the annular portion. This would include, but not be limited to, butt welding, fusion of the sheet material to the annular segment, adhesive stripe between the annulus and the center portion, thermal welding, ultrasonic welding, hot melt adhesive, etc. The application of an adhesive may be the most likely to cause raised areas which could be avoided, but existing process technology makes controls over the dimensions of the adhesive very effective. Additionally, since the adhesive would be much softer than the abrasive material, some sacrificial abrading on the inner edge of the annulus could be performed to lower any edges. Therefore, some conditioning grinding or lapping at the inner edge of the annulus could be performed before the abrasive sheet is used for its primary effort at lapping.

Another method for forming such a sheet would be to cut out an annular ring of abrasive sheet and lay it over another plastic circular sheet having an outside diameter approximating that of the annular cut-out (it may be somewhat smaller or larger). This andwich could be joined together by any method which would maintain a consistent thickness to the abrasive sheet, since the highest quality coating methods could be used in joining these layers (the circular and annular disk), even adhesive securement is useful, where because of process limitations in the application of adhesive to the platen to secure the abrasive sheet, adhesive securement would not be desirable between the abrasive sheet and the platen. Securement might also be made between the annular ring of abrasive and a backing sheet by thermal welding, ultrsonic welding, or any other method, particularly those which seal the entire circumference of the joining line between the annular sheet and the backing sheet to prevent liquid and particles from entering the seam. A poor seam closure would allow edges to lift or pull and would be undesirable.

An annular disk provided with a natural raised outside area of abrasive could be easily used on a flat platen surface. Other structures of abrasive sheets with attached central areas, where the sheet has a height of the central area and the abrasive area relatively equaly may need a platen with a rasied annular area on the outside of the platen to take the greatest advantage of the annular configuration, although if the central area were minimally abrasive or minimally hard, contact between the central area and the piece part during lapping would have negligible or even beneficial (buffing) effects and the sheet could be used on a flat platen.

The annular band or sheet with an annular distribution of adhesive may be secured to the platen by a number of different means. Positioning of vacuum holes or ports or vents in the platen can be effectively arranged. For example, vacuum holes may be located exclusively inboard of the annular band to assure that no imprint of the hole is transmitted across the abrasive sheet to the abrasive surface. With the use of appropriately sized holes, this potential effect has not occurred, but this positioning of the holes allows for such a distribution of relatively larger holes or vents if desired. Rows of holed directed relatively radially through the underside of the sheet from the radial portion into or towards the center area may be used. Concentric circles of vents or ports may be located, some or all in the center area or under the abrasive annular distribution. Pressure sensitive adhesive may be used in limited areas, such as in the center area only, where there would be no possibility of adverse affects on the consistent level of the abrsive or buildup effects. The adhesive could be used alone or in combination with vacuum retention in that area or with the vacuum in areas not secured by adhesive. Pressure senstive adhesive could be located outside the annualr area of the abrasive, and thereby not affect the level or eveness of the abrasive surface. It is possible to have some adhesive under the annular ring of abrasive, but this would, of course, detract from the evenness and ease of replacing the sheets.

High friction, rough surfaces may be provided on the platen to assist in the draw down of the abrasive sheet. When an entire disk (rather than just an annular ring with no center portion), the vacuum holes or vents are sealed by the disk, particularly at the inboard portion of the sheet. It is therefore important that all holes underneath the sheet be in vacuum tight relationship with the sheet to prevent debris from entering the holes, clogging them, and providing deformities on the surface of the sheet. The debris can also gring away portions of the holes or vents, later disturbing the disk surface. The pattern and distribution of the holes can therefore be important. The best distribution todate appears to be with a completely continuous sheet (not even a centering hole) and concentric circles of holes predominating in the center area and minimized (or even absent) rom the annular abrasive distribution area. A problem with the use of a centering post is related to this phenomenon, in that ebris may enter underneath the sheet around the centering post and gradually cause adverse changes in the holes or platen surface. Also liquid flow variations and different volumes and sizes of particulates may be flung outwardly, underneath the sheet, if such materials enter the space between the platen and the sheet through access around the centering post.

24. VIBRATION DAMPING IN THE LAPPING APPARATUS

Problem: The motor driving the platens and/or work piece holders (if they move) apply vibration to the entire lapping system. The rotation of the platen itself provides vibration, as does the movement of the abrasive over the face of the work piece. The flow of liquid over the lapping contact zone (between the platen and the work piece), especially where there is any hydroplaning or uneven distribution of the liquid over a moving surface, also creates pressures and forces which can add vibration into the lapping system. These vibrations in the system can cause minor instantaneous variations in the relative positions of the platen and the work piece. These variations, of course, show up in reduced lapping quality in the product and are undesirable.

Solution: The weight of the frame an the individual elements (the platen and any moving or stationary work piece holder must be designed to minimize vibration. The joints between elements and attachments of moving parts must also be controlled to minimize vibration. The primary method of reducing or damping vibration is to add mass to the frame and to strategic portions of the apparatus. The frame of the system should weigh a minimum of 100 kg. also an energy-absorbing member or layer (e.g., a viscoelastic layet) may be present between concentric tubular structural beam members and between flat plates where one flat plate is merely a flat mass unit which tends to remain stationary in space while the first plate integral to the frame has vibration excitation induced between the two plates. The thin elastomer layer is sheared across the thickness and, due to its very high viscosity, will absorb the vibration energfy and dissipate it into heat. All of the vibration damping systems would be designed specifically for portion of the machine, especially with respect to localized natural frequency, its expected amplitude multiplication (which can easily exceed fifteen times the oscillation excursion of the excitation source), the design and characteristics of the vibration damping/absorbing device, and the different multiple frequencies expected. Secondary spring-mass systems can also be utilized by positioning masses with spring supports tuned to the excitation frequency by the formula Wn=the square root of k/m where Wn equals the natural frequency in Hz, k equals the spring constant in pounds/inch, and m equals the mass in pounds, with the necessary constants required for equation units (e.g., such as gravity acceleration of weight in pounds to mass in slugs). The secondary spring mass tends to oscillate at the same frequency as the excitation frequency, but out-of-phase, so as to cancel out the excitation frequenct force.

Another vibration prevention device is the use of a large, thick, heavy flat plate weighing 90 kg or more mounted horizontally in the same plane as the platen at about the same level as the platen. This mass tends to absorb any vibration due to imbalance of the platen/abrasive sheet combination assembly. This prevents the vibration motions from exciting the machine frame in such a way as to oscillate the piece part being ground or lapped. Adhesively bonding a viscoelastic layer to this flat mass plate and bonding another large masss flat plate to it can very effectively reduce the buildup of vibration oscillations.

Some other vibration excitation sources can be the platen system being out of balance, the piece part spindle being rotated when out of balance, oscillations being generated by the stick-slip conditions between the barsive sheet and the work piece, hydrodynamic fluid-induced vibrations at the moving fluid boundary layer interface between the piece part and the platen, sudden motion of machine elements, electrical pulses, etc. Vibrations should be prevented from entering the system, wherever heir source. Adding a large mass ring of heavy, dense material to the outboard diameter of a (typically) round workpiece holder in a fashion which allows the center of gravity as close as possible to the moving abrasive surface is a very effective method of minimizing vibrations in thw work piece. The mass attenuates vibration excursions and isciullatory vibration forces generated at the abrasive surface contact area. The same mass will alos interrupt vibrations originating from the machine motor drive, and platen imbalance (insofar as it would travel down to the workpiece support mechanism).

For a lightweight, small manufacturing model. More preferably at least 200 kg, still more preferably at least 350 kg. And most preferably at least 500 kg., with no maximum weight contemplated except by the limitations of reasonableness. The weight of the actual commercial embodiment of the present invention is about 600 kg. The platen at a revolutionary speed of 3000 rpm with a twelve inch (30.2 cm) diameter has a natural frequency of 50 Hz. The frame should be designed with a natural frequency above the frequency of the highest useful speed of the platen (and motor). For example, with the maximum designated speed of a lapping apparatus with 30.2 cm platen and abrasive sheeting being 3000 rpm with a frequency of 50 Hz, the natural frequency of the apparatus frame should be at least 2% above this operating frequency. Greater differences between the operational frequency (the Hz equivalent of the rotational speed of the platen) and the natural frequency of the frame would provide additional levels of vibrational avoidance at the higher speeds, so that natural frequencies more than 3%, more than 5%, more than 10% or more than 20% of the operational frequency are desirable. Operating equipment used by Applicant in the practice of the present invention has been made with 3000 rpm operational speeds (50 Hz) and 76 Hz natural vibration frequency. This enables the frame of the machine to be operated at higher speeds and higher frequencies (e.g., 3600 rpm and 60 Hz, and 4200 rpm and 72 Hz) by increasing the capability of the motor, replacing the motor, but not significantly modifying the frame. If need be, weight and mass may be added to the frame after construction to improve vibration resistance. Damping material, such as elastomeric materials may also be added at strategic sites within the frame and apparatus, such as at joints, between a work frame and the main frame, over bolts and nuts (if present), between legs on the frame and the floor, etc. The purpose of these features being to mask the vibration or dampen it, as by increasing the natural vibration frequency of the frame to a meaningful level (e.g., at least 2 Hz or at least 2%) above that of the operational frequency of the lapping apparatus.

25. LAPPER PIVOT CRADLE PIECE PART HOLDER

Problem: When a piece part is ground or lapped on a high speed (e.g., diamond) abrasive disk with surface speeds of about 9,000 sfpm or higher, with a 12 inch (30.5 cm) diameter platen rotating at 1,500 rpm or 3,000 rpm or more, there can be an uneven grinding action due at least in part to the boundary layer between the piece part and the abrasive surface. There can be a thinner layer at the outer periphery of the circular boundary layer due to the high relative surface speed at that outer region. The relatively much slower surface speeds at the inner radial region of the disk will conversely have a thicker boundary layer because of the slower speeds and the fact that the same volume of liquid is moving over a smaller area (the area defined by the smaller radius) at a slower speed. Typically abrasive particles at the outer radius of the rotating platen more easily penetrate the thinner boundary layer at the outer periphery of the disk and effect material removal more efficiently in that region than where the boundary layer is thicker. Therefore, the abrasive activity is affected not only by the differential in surface speeds between the inner region and the outer region, but also there is another effect because of the variation in the thickness of the boundary layer between radially related regions. Thus the abrasive particles integrally attached to the abrasive sheet may be held away from the work piece and not remove material as efficiently. This causes uneven wear and lapping on the piece part due to the boundary layer effect which has not been previously considered in this technical field.

Solution: The use of an annular ring, with the inner and outer radius of the center opening and external edge, respectively, being sufficiently close in dimensions that the relative velocity of the two surfaces, and more importantly the thickness of the boundary layer at both of these radial positions, are within a narrower variation than previously used. It is important to note that this effect is important for the high speed lapping process of the present invention, and would have had an insignificant effect at the 5–200 rpm rotational speeds common to previous grinding processes. The high rotational speeds create the dramatic boundary layer changes for which this invention is important. Even if annular disks had been used with slower speed grinding, polishing or lapping processes, the benefits of this aspect of the present invention would not have been noted, even if the benefit was provided by such lower speed annular disk usage. It would be desirable to have the boundary layer thickness approximate the average height of the abrasive materials protruding from the support surface (e.g., from 1 to 100 micrometers). It is desirable that the boundary layer thickness approximate that height with a variation of no more than±50% of the average abrasive particle height, more preferably±30%, still more preferably±20%, yet more preferably±15%, and most preferably within±10% of the average protrusion of the abrasive particles from the average height of the substrate (e.g., the valleys formed by the binder). The process may be performed with two piece part holders, each rotating in a direction opposite (clockwise versus counterclockwise) from the other. Both holders may be mounted on a common pivot arm. each piece part holder would tend to stabilize the other and would also allow each of the piece part holders to stabilize the other across the width of the platen. A special wobble joint at each piece part holder would allow each to conform to the slightly uneven boundary layer on the platen. Rotating each piece part holder would provide the same amount of abrasive material removal to the exposed surfaces of the piece parts. The normal force, surface speed, liquid flow rate, viscosity, etc. would all be optimized in the entire assembly. The assembly pivot cradle would be oscillated to obtain even surface wear.

This aspect of the invention can be considered with respect to cutaway FIG. 9. A lapper platen system 130 is shown which comprises a shaft 132 is connected to a rotation source (e.g., an engine, not shown), a platen face 134 on which will be secured an abrasive sheet (not shown). The platen face 134 contains ports 136, 138, 140, 142, and 144 through which reduced pressure may be provided to the platen face 134. A spherical or torroidal element 146 (hereinafter referred to as the "ball 146") with a flattened or flat beveled bottom portion 148 is secured by a flat internal face 150 to the lower portion 152 of the shaft 132. The rounded outer surface of the ball 146 is supported by pairs of spherical-faced bearings 154, and 156, and 158 and 160, which may also be a pair of torroidal bearing elements with concave spherical faces contacting ball 146. Over said upper spherical faced bearings 154 and 158 are flexing elements 162 and 164. This may be any spring-like elements, coils, or spring washers which provide a cushioning effect or spring effect between said upper spherical bearings 154 and 158 and bearing securing means 170 and 168 which help to secure the upper bearing elements 154 and 158 against movement and provide a stabilizing and positioning force to the ball 146. A convenient securing means may be a circular nut with spanner wrench holes, with threads on the sides to fix into the platen neck 172. A cushioning material 174 and 176 are provided between the shaft 132 and the interior surface 178 of the platen neck 172. If a force is applied to the face of the platen 134 and the force is slightly uneven distributed against the face 134, the face of the platen may adjust to the force and level itself by pivoting through ball 146. The degree of pivoting is cushioned by internal resistance of the ball 146, and the elastic resistance of the cushioning materials 174 and 176. A lubricant (not shown) may be provided in any cavities 180 and 182 which exist between the cushioning material 174 and 176 and the ball 146. The lubricant may be any preferably liquid lubricant such as an oil. The cushioning material 174 and 176 may be any flexible composition, such as, but not limited to, natural or synthetic rubber, silicone or fluorine containing elastomers, spring elements, or the like. Lubricant may be provided by syringe injection into the cavity 180 and 182 or may be provided through a replaceable cap (not shown).

FIG. 10 shows a preferred flexing element for use with the present invention, a Bellview spring washer 190. This element is no more than a standard washer whose outer periphery has been bent down to form a truncated cone shape. These Bellview spring washers may be stacked to form a spring-like element.

It is desirable to limit the degree of pivoting which this aspect of the invention may undergo. During an emergency, a limitation on pivoting, beyond that provided by friction and the cushioning materials 174 and 176. One method according to the present invention is shown in FIG. 11. A platen-shaft system 198 may comprise a platen 200 with a front face 202 and an internal anti-pivot shaft 204. The anti-pivot shaft 204 is separated from the inside face of the platen shaft 206 by a distance of A. The platen 200 may not pivot any angle greater than that which would cause the anti-pivot shaft 204 to contact the inside face of the platen shaft 206. By adjusting the dimensions of the respective elements (e.g., the length and thickness of anti-pivot shaft 204, dimension A, etc.), the limits on the degrees to which the platen may pivot can be preset.

This aspect of the invention may be described as a pivoting lapper platen system comprising:

a) a shaft which is connected to a platen, said platen having a back side to which said shaft is connected and a front side on said platen to which can be secured an abrasive sheet;

b) a pivoting joint comprising a spherical or torroidal element comprising a curved outside surface, and said pivoting joint being located on the outside of said shaft, said pivoting joint having an arcuate surface area and a receding surface area of said outside surface of said pivoting joint, and said receding surface area is closest to said platen;

c) said pivoting joint having a cross section with an effective center of its area, said receding surface area of said pivoting joint being defined by a surface which has average distances from said effective center which are smaller than the average distances from said effective center to said arcuate surface area;

d) arcuate surface area of the pivoting joint is supported by at least one pair of arcuate-faced bearings, said bearings comprising at least one upper bearing and at least one lower bearing, said bearings being attached to a portion of said platen, and allowing said pivoting joint to pivot between said at least one pair of bearings;

e) said shaft being able to pivot about said pivot joint relative to said platen.

The platen system may have over said at least one upper bearing a space between said shaft and a neck of said platen, said shaft being restrained within said space by a cushioning means between said shaft and an interior surface of said neck, said cushioning means being selected from the group consisting of flexible compositions and springs. The platen system may have said cushioning means comprise a flexible composition, and may have said cushioning means comprises an elastomeric composition, as previously described. As previously noted, said elastomeric composition preferably comprises a silcone elastomer or a fluoroelastomer. The platen system, between said flexible composition and said at least one upper bearing may have a spring element, and above said spring element and below said flexible composition may be a securing element, said securing element being capable of being adjusted in a direction parallel to said shaft to increase force upon said spring element, said force on said spring element in turn increasing force of said at least one upper bearing to press said bearing against an arcuate surface of said pivoting joint.

The platen system may have at least said flexible composition, spring element, shaft, at least one upper bearing and pivoting joint creating a cavity with said platen system. The cavity peferably contains a liquid lubricant.

To restrict non-lapping (out of plane) rotation of the platen, the platen system may have an elongate element which is associated with said platen so that movement of said platen, out of its natural symmetric rotation plane as is used during lapping, causes movement of said elongate element, said element extending from said back side of said platen through an interior channel of said shaft so that said movement of said elongate element when said platen pivots will cause said elongate element to contact an interior surface of said shaft, restricting the amount of pivoting which said platen can perform. The elongate element will contact said interior surface of said shaft when said platen is turned less than 30, preferably less than 20, more preferably less than 15 degrees, and most preferably less than 10 or 5 degrees.

The platen system may use a spring means or spring element which comprises a stacked array of truncated hollow cone elements stacked upon each other.

This system is a great advantage over a simple ball bearing type of design for a number of reasons. Fine abrasive grit can easily get into a ball bearing, while the pivot center of this design is fully enclosed. Even if some grit does enter the system, the oil can support it, wash it out, and remove it almost completely with replenishment of the lubricant. A spindle holder (or the platen shaft) is never uniformly and consistently perpendicular to the platen. A perfect ball bearing would be very loose and could cause the platen to contact the workpiece in a manner to cause abrasive damage from the first contact, while the cushioning material (the elastomer) used in the present invention stabilizes the platen direction and tilt within a more controllable range. The use of an elastomer is preferred over spring support of the shaft because it also provides an added measure of vibration damping.

26. ANNULAR DISK ON A RAISED PERIPHERAL PORTION OF THE PLATEN

Problem: Sometimes the extreme liquid pressures and forces can drive the liquids under an interior edge of an annular disk. Once the edge is lifted, many undesirable events can occur. The annular abrasive disk presents an uneven face, since one edge is deformed from planarity. Residue from the abrasive disk and swarf material from the work piece can embed themselves under the raised edge. Each of these distortions of the abrasive surface are undesirable and can damage the workpiece.

Figure 5:
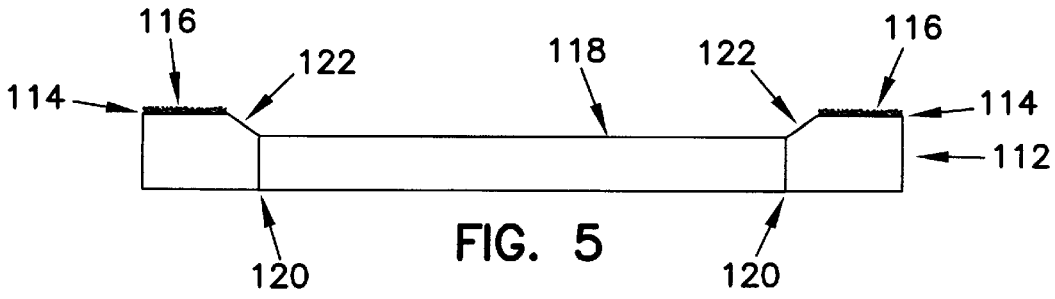
FIG. 5 is a side view of a platen with raised peripheral edge portions.

Solution: There are a number of solutions to this problem. One basic consideration is to provide an abrasive sheet which does not have any openings in its surface. This can be done by having a circular sheet with no holes therein coated with an annular ring of abrasive material. A circular abrasive sheet may have the core circle of abrasive scraped or abraded off to leave an annular distribution of abrasive on an impervious sheet backing. An annular disk with an opening in the center may be provided with a "plug" or circular piece that completely fills the central area. As shown in FIG. 5, an annular disk 112 having annular, flat support area 114 with abrasive on the upper surface 116 may have a plug 118 which abuts (and is preferably secured to) the inside edge 120 of the annular ring 112. An area 122 between the flat annular surface support area 114 and the inside edge 120 is shown with a bevel, but this is not essential. Securement between the plug 118 and the interior edge 120 may be effected by direct fusion (by heat or solvent) of the two pieces, adhesive or the like.

Figure 6:
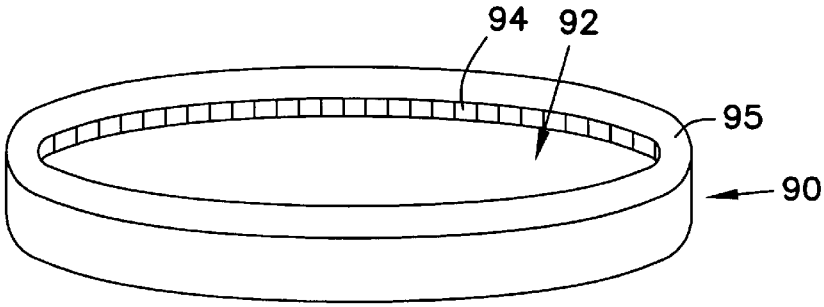
FIG. 6 is a perspective view of a platen with raised peripheral edge portions.
Figure 7:
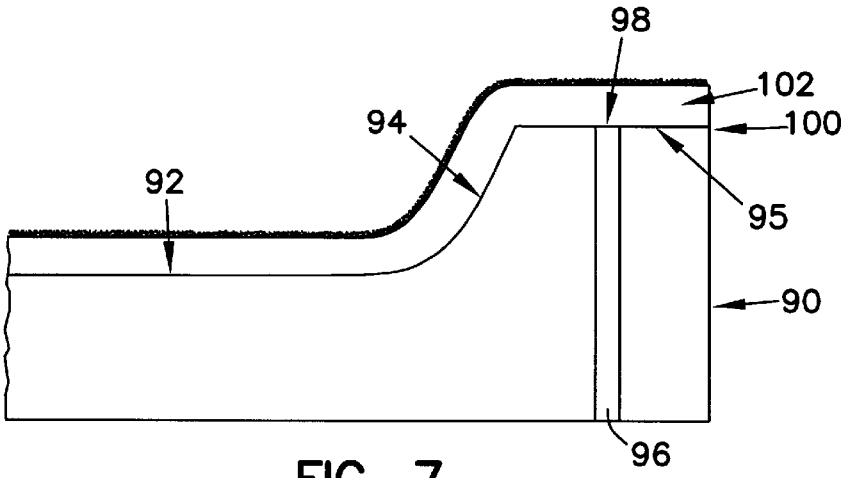
FIG. 7 is a cutaway view of a platen with raised peripheral edge portions.
Figure 8:
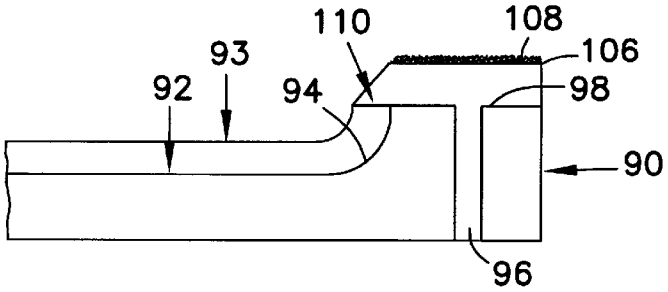
FIG. 8 is a cutaway view of a different configuration of a platen with raised peripheral edge portions.

FIG. 6 shows a platen 90 with a depressed region 92 and a wall 94 between the flat upper annular support area 95 and the depression 92. A number of means are available for providing an annular abrasive disk or annular abrasive work surface (not shown) on this flat portion 95. FIG. 7 shows one of these methods. The platen 90 has an abrasive sheet 100 on its surface. The sheet 100 comprises a backing layer 102 and abrasive material 104. A vacuum port 96 (or other securement means) retains the back surface 98 of the sheet 100 against the flat annular surface 95. The reduced pressure will be passed along the back surface 98 press the sheet 100 against the flat surface 95. The reduced pressure will also secure the sheet 100 against the wall 94 and the depressed area 92. The wall 94 is shown with an arcuate slope, but may be more sharp or smooth in the transition from flat area 95 to depressed area 92. For example, the transition may be by two right angles or by an S-shaped curve or other form. FIG. 8 shows a platen 90 with a plug 93 which is secured to the backside 98 of the annular sheet 106 with abrasive 106 on it. The location of the abutment 110 between the backside 98 of the sheet 106 and the plug 93 is shown at an approximately right angle, rather than the edge-on abutment of FIG. 5. The abutment 110 of FIG. 8 may be by means similar to those described for the joining of the plug 118 and the flat annular support 112 at the abutment 120 in FIG. 5.

27. RAPID WEAR IN PARTICULAR AREAS OF THE ABRASIVE SHEET

Problem: Abrasive sheets, even in annular form, tend to wear in a specific pattern. The precise positioning of the sheets or ring against a work piece causes the same radial portion of the abrasive surface to be in contact with the work piece. This tends to cause the abrasive surface to wear down in specific circular lines or annular areas. As the abrasive surface is not as useful where there is a discontinuity in the abrasive, the remaining sheet may have to be discarded because of the absence of abrasive over only 10–20% of the sheet work face.

Solution: Working at high rotational speeds, the centering of the sheet or annular disk on the platen was assumed to be very important, mainly because the radial forces would have been though to be sufficient to create significant damage to the sheets, literally ripping them apart with the force, or the creation of vibrations which would effectively distort the relative face of the abrasive sheet. It has been surprisingly found that not only would the off-centering of the sheet or annular disk not create damage, but such off-centering could prolong the life of the abrasive work surface. By positioning the center of the sheet or annular disk at least 1%, preferably at least 2–5% (even up to 10–20% of the radius, off-center) of the radius of the sheet or annular disk away from the center of the platen, the work surface of the sheet or the annular disk would effectively oscillate, rather than present the exact same radial dimension to the work piece. This oscillation, since it is unlikely to repeat in a single rotation of the platen, would expose different areas of the abrasive work surface to the work piece. Abrasive material would be removed in broader (wider) annular patterns, as compared to the more narrow annular patterns that would be worn in the work surface of a perfectly centered abrasive sheet. The degree of off-centering useful or tolerable in the system is related to the rotational speed and the density of the abrasive sheet. The greater the rotational speed, the heavier (higher weight per unit surface area) the abrasive sheet, the less off-centering which may be tolerated. It is also quite useful to provide a massive (heavy) support for the work piece and platen. The heavy apparatus pieces will help to dampen vibrations that may occur by the eccentric rotation of the sheet or annular disk.

Additionally, the abrasive disk could be either intentionally repositioned at its exact original position or a different position by use of a marker system. Even a felt-tip writing implement could be used to mark on the abrasive disk and/or the platen where it was exactly located on the platen relative to the mark, or a permanent marking system on the platen. An barasive disk may then be removed and reinstalled at nearly the identical radial and tangential position on the platen without requiring the disk to be redressed each time that it is used. Furthermore, the abrasive disk could be sequentially or progressively or randomly moved tangentially to align "low" wear areas of the disk with "high" eleveation areas of the platen which would better utilize all of the expensive abrasive particles of the disk. Small increment tangential repositioning of the disk would reduce the requirement for re-dressing the disk as many of the causes which require re-dressing—platen high spots, thickness variations in the abrsive disk, etc.—tend to then be distributed in areas rather than at specific points which is more tolerable within a lapping system.

The abrasive disk can also be preconditioned so that high defect spots or areas are reduced in height to reduce the possibility of local scratching on the work piece surface. A hard material can be held stationary against the disk surface (particularly at an edge) or the hard material may be oscillated slowly and radially to knock off or wear down high spots. Another abrasive material could be rotated with its own high (or slow) velocity against the surface of the abrasive disk to remove high spots or loose materials. Any loose or weak abrasive materials at the inner or outer radius of the disk would be broken loose by this initial conditioning treatment and would be eliminated from the system prior to actual lapping of the work piece.

28. AVOIDING DAMAGE FROM FLYING DEBRIS

Problem: Because of the higher rotational speeds that can be used in the present invention, liquids, swarf, removed abrasive and the like is hurled at extremely high velocity away from the platen. With linear velocities of 20,000 feet per minute, debris is constantly projected from the surface at over 200 miles (280 km) per hour. This projectile material can cause serious damage to person around the machine, and upright box-like protective enclosures (particularly with flat upright surfaces at right angles to the path of the projected materials) are readily worn away by the projected matter, much of which can be abrasive material. Additionally, the particulate waste can accumulate against surfaces and the liquid will also run over any flat surfaces.

Solution: The platen may be enclosed in a sunken box or walled area, with significant space below the platen to a lower surface for the containment area. The surface of the platen and the surface which is contacted by the abrasive sheet should be below the upper edge of the protective walling-in enclosure. Preferably the plane formed between the work piece and the abrasive sheet should intersect the wall element at least 1 cm below the highest part of the wall. Preferably there should be at least 2 cm of such clearance, more preferably at least 4, 5 or even 10 cm of wall above that plane. The distance below that plane to the floor of the containment area should be at least 5 cm, more preferably at least 10 cm, and my be 20–50 below the plane. Abraded material may harmlessly collect in the floor area, and the area cleaned out from above (around the sides of the platen or by moving or removing the platen) or from below (by an access panel or regular drainage system). The collected materials may be more readily disposed of and collected in this manner. The walls of the enclosing elements may be metal, coated metal, composite, abrasion-resistant coated material, or sacrificially coated materials. The walls may be sloped outwardly so that impacting material may be reflected down towards the floor/collecting area. The entire enclosing structure may be removable most easily down from the bottom of the work area, there may be constant or sporadic drainage allowed through the floor area, and the like.

29. LINE CUTTING, LAPPING OR POLISHING WITH AN ANNULAR FACE OF ABRASIVE

Problem: It is often desirable to control the application of the abrasive material to a substrate so that a specific pattern and particularly a straight line of lapping is effected on the work piece. This type of polishing could be done with a rotating wheel abrasive disk with the side edge coated with abrasive so that the abrasive action is directed against a plane parallel to the axis of rotation of the disk. Sheet material is not naturally thought to be applicable to such a process unless the sheet material were applied along such an outer edge. The flat front face of a platen could not create a straight line contact between the abrasive and a workpiece. Unless a beveled face as shown in U.S. Pat. No. 4,219,972 was used for the abrasive grinding wheel, there could be no such possibility for any line or flat surface lapping unless an entire surface were to be treated. That type of configuration would not be expected to be amenable to abrasive sheet material, as the potential for wrinkling in fitting the sheet to the outer edge would seem to be significant. Additionally, there has been no disclosure of the use of sheet applied materials on beveled edges of lapping or polishing materials as only flat sheets in rectangular and round facial patterns have been provided.

Solution: A platen 220 is provided with an upper surface 222 (which is shown in FIG. 12 as a flat surface with ports 226 for securing sheets to the surface. On the beveled side edge 224 are additional air vent ports 230 for securing subsequently applied abrasive sheet material 228 to said edge 224. A circular sheet of abrasive material (not shown) or an annular sheet of essentially two dimensional conformation 228 may be applied to the upper surface 222 of the platen 220. A flat abrasive sheet (not shown) would be secured by reduced air pressure through ports 226 on the upper surface 22 of the platen 220. It is to be noted that because of the beveling of the edge 224 of the platen 220, it is not necessary that the upper surface 222 of the platen 220 be flat. That surface may be rough, smooth, arcuate (e.g., spherical segment), or any other shape, with or without features, since the lapping surface is no longer a face of the platen but is the beveled edge 224. The edge is beveled at an angle between 1 and 89 degrees away from the top surface 222 of the platen 220; preferably the angle is between 10 and 80 degrees, more preferably between 15 and 75 degrees. When an essentially two dimensionally formatted abrasive sheet 228 is applied from above the platen to the upper face 222 of the platen, pressure (and/or heat) may be used to conform the sheet 228 to the beveled surface 224. The pressure from reduced air pressure through ports 230 may not be sufficient to form the sheet 228 and additional pressure as from a mold overlay (not shown) which match the shape of the beveled platen 220 may be needed. It has been surprisingly found that the sheet 228 may be formed over the surface without distortion of the configuration of the sheet. No wrinkles are formed in this fitting procedure. As one of ordinary skill in the art knows, normally when an annular sheet-like object in sheet form is fitted over a truncated conical form, the sheet distorts and forms wrinkles when attempting to conform to the surface. The sheet material backing on commercial abrasive sheeting has been found to be able to conform without wrinkles when pressed onto the beveled shape. This is believed to be in part caused by elastic or inelastic give in the backing material itself. What is additionally surprising is that with the stretching or reconfiguration of the backing material, the essentially uniform abrasive surface of the abrasive sheet is not adversely disrupted. This is particularly surprising since the uniformity of the distribution of the abrasive material on the surface is so important to the quality of the lapping process, and the amount of elastic conformation at the lower edge of the platen may be 10% or more.

The beveling of the edge provides a geometry to the edge that when, as shown in FIG. 13, a workpiece 240 is addressed by the beveled edge 224 of a platen 220, the beveled edge 224 is parallel to a surface 232 of the workpiece 240. Additionally, a relatively clean line contact is made between the beveled face 224 and the face of the workpiece 232 so that a relatively flat lapping contact is made. The shape of the area removed 234 by extended contact with the edge 224 of the platen would be nearly rectangular (for most purposes), and only if the lapping were used in more of a grinding fashion would an angularity in the wall 236 be noticeable while there was only a right angle configuration on the distal wall 238 of the area 234. An angularity or pitch in the wall 236 while the distal wall 238 was relatively perpendicular to the face 232 of a ground area 234 would be a fingerprint of the practice of the present invention.

The use of the annular ring with the beveled edge geometry has numerous benefits and improvements over a cylindrical section or disk element for the grinding wheel. Systems of grinding wheels with abrasive on the outside periphery of the wheel (not on the flat face) are known for systems where the abrasive is part of the wheel material itself (e.g., a grindstone) or coated onto the edge. An abrasive sheet material does not lend itself to facile application or use on such an outer edge, both for technical and mechanical reasons. There are basically three ways in which a sheet material could be applied to the outer edge of a grinding wheel: 1) coat abrasive on a cylindrical sheet and cut continuous sections from the sheet which fit the grinding wheel diameter; and 2) cut strips of abrasive sheet material and adhere them to the surface of the edge. The first method would involve a specific new manufacturing process and technique to manufacture such a continuous circular element, and the tolerances for good fit to the wheel would be quite small. It is possible to have the backing layer of the circular cut element shrinkable to fit the article more tightly to the wheel, but adhesive would have been desirable, and this leads to disuniformity. The vacuum hold-down of the present invention would have helped in this format, but the new manufacturing procedure would have still been needed.

The second manner of providing an abrasive edge to the wheel would have required that the strip be attached at its ends to form a circular element. This would require the formation of a joint or weld, which would be likely to provide a weak spot, an elevated patch, a wrinkle, or other aspect which would not lend itself easily to use in the fitting of pre-made abrasive sheeting to the end of grinding wheel.

The use of the completely beveled edge on the platen in this aspect of the present invention provides a mechanism for providing a continuous strip of abrasive sheeting made by existing technology and available as a staple in the market place as an abrasive surface on a high speed lapping system which can provide linear lapping and polishing as well as complete surface lapping. It is an attribute and fingerprint of this aspect of the present invention to provide a platen with a beveled exterior edge and a continuous strip of abrasive sheet material on at least the beveled edge. The particle distribution in the abrasive sheet may well result in a gradient of slightly lesser density of particles in the upper, smaller diameter region of the beveled face than in the lower, larger diameter beveled face. This particle density may be as slight as 1, 2, 5, or 10% depending upon the angle of the bevel and the degree to which the underlying support sheet has been shaped by the fitting process. This minor particle density variation has not been noted as providing any adverse effects on the lapping quality provided by this configuration, and the important fact is that the shaped annular disk conforms well to the beveled face and provides a very consistent and smooth orientation of the abrasive sheet upon the beveled edge.

30. UNEVEN WEAR ON THE SURFACE OF THE PLATEN WITH AN ANNULAR ABRASIVE AREA

Problem: Because of the high rotational speeds of the platen and the abrasive sheet material on the lapping face of a platen, there is uneven wear between a radial outer area of the abrasive material and a radial inner area of the material. There are difference in the linear speeds at the two areas, the amount of surface area each incremental area of the abrasive addresses, and therefeore there is more rapid the wear in the abrasive surface towards the outer edges and likewise more rapid wear on the workpiece.

Solution: In FIG. 14, a workpiece 254 and a platen 250 with an abrasive surface 252 address each other. The workpiece 258 has an effective center line A-B. The workpiece 254 is moved so that the center line A-B spends more time inside the outer edge of 260 of the platen 250 while the abrasive surface 252 of the platen 250 and the workpiece 254 are in contact during lapping. By distributing or shifting the majority of the time of contact between the abrasive face 252 and the workpiece 254 towards this interior region, there is less wear on the outside edge 260 of the platen 250. As the most serious wear and damage to the workpiece 254 can occur with excessive wear on the outside edge (as cracking, flaking, and sharp edge features can more easily develop, this is an important improvement in the wear performance of the abrasive sheet material 252. FIG. 13 shows that the direction of rotation 256 of the platen 250 is opposite the direction of rotation 258 of the workpiece 254. This aspect of the invention works even better where the workpiece is rotated at the same time that the platen is rotated, to more evenly distribute the time and position of orientation of the workpiece and the abrasive surface. Even if uneven wear does occur, the dual rotation of the workpiece and the abrasive sheet on the platen will reduce any linear effects or artifacts on the workpiece surface. The rotation 256 258 does not have to be in opposite directions, but this is the preferred mode of practice.

The time when a workpiece is in contact with an abrasive sheeting is referred to as the total contact time Tc. The time when the center of the workpiece is inside (not merely directly aligned with) the outer edge of the agrasive surface must be at least 50% Tc when operating at a constant speed. That is if the speed of rotation of the platen decreases, the Tc must be weighted according to the surface area fanned or covered by the workpiece. Operating at a constant speed, it is preferred that the workpiece center be within the outer edge at least 60% of the time, more preferably at least 75% of the time, still more preferably at least 80 or 90% percent of the time, and it is most preferred and most convenient to have the center of the workpiece aligned within the outer edge of the rotating platen at least 95% and even 100% of the Tc.

The combined effect of moving the center of the workpiece inward of the outer edge and the rotation of the workpiece not only reduce uneven wear on the abrasive surface, but provides a synergistic effect in reducing the potential uneveness of lapping/polishing on the surface by both improving the consistency of the abrasive surface addressing the workpiece and reducing any linear effects that any uneveness in the abrasive surface could cause in the workpiece. Additionally, by having an eccentric or non-repetitive movement of the workpiece with respect to the rotation of the abrasive surface, there is even less likelihood of any linear uneven lapping effects upon the workpiece surface.

In the system where the center of the work piece is off-set so as to be located predominantly inside of the outer edge of the abrasive sheet, the lapping set-up may include multiple workpieces. As the platen carrying the abrasive sheet is rotated, a workpiece will normally cover or be in contact with only a very small fraction of the surface of the abrasive sheet. This leaves space or areas on the abrasive sheet available for additional lapidary work. It is convenient to have multiple workpieces distributed about the periphery of the platen carrying the abrasive sheet. At least one workpiece should be oriented as described above with respect to the relative position of the center of the workpiece and the outer edge of the abrasive sheet. Preferably more than one of the workpieces and most preferably all of the workpieces are so oriented. To increase the effect of reduced uneven wear according to the practice of the present invention, at least two of the multiple workpieces should be rotating in opposite directions with respect to each other. That is, when viewed from one direction perpendicular to a platen face, at least one workpiece will be rotating clockwise and another will be rotating counterclockwise. It is preferred that with an even number of workpieces, clockwise and counterclockwise rotation is evenly distributed and alternative between the workpieces, and with an odd number of workpieces, the numerical distribution would be n+½ and n−½ for clockwise and counterclockwise workpieces, with only one pair of adjacent workpieces rotating in the same fashion.

This format of distribution with respect to a lapping surface is useful in the practice of the present invention whether an entire platen surface is covered with abrasive sheeting or whether an annular distribution of abrasive sheeting is provided. The problem of uneven wear occurs in both type of systems, the potential for damage is present in both types of systems, although it may be somewhat magnified in the annular system since there is less surface area to work with and so any degree of uneven wear provides greater likelihood for that uneven portion to contribute to damage to the workpiece surface. This is simply a matter of probability in that any damaged area has a greater probability of being in contact with a workpiece when it constitutes a larger percentage of the total abrasive surface area.

It is also a consideration in the operation of a lapping apparatus using the conformation of work piece positioning and the outer edge of the abrasive sheeting to assure that at least some of the contact time of the work piece and the abrasive platen positions the workpiece over the outer edge of the abrasive sheet, and if an annular distribution of abrasive, over the inner edge of the abrasive distribution. The passage of the work piece over the edges of the abrasive distribution avoids the formation of ridges on the abrasive surface. By rotating the work piece while the platen is spinning, differing areas of the work piece are presented to areas of the abrasive sheeting. More importantly, however, buildup of ridges are avoided by the extension of the edges of the workpiece over the outer (or inner with an annular configuration) edge of the abrasive distribution. The extension should cover at least 1%, more preferably at least 3%, still more preferably at least 5%, and most preferably at least 10% of the Tc of the particular operation.

Another operation which proves to be of benefit in the operation of the lapping apparatus is to precondition the outer edges of the abrasive sheeting before actual lapping of a work piece. Such sacrificial lapping on the outer edge for a brief period of time (e.g., less than 50%, preferably less than 25% or 10% of the actual Tc for the next intended work piece, e.g., for 1–5 seconds) can remove manufacturing or conversion (cutting) deficiencies in the outer edge. This has been found to assist in reducing the occasion and occurrence of particulates being dislodged in the outer area and wedging themselves between the abrasive sheet and the piece part.

31. GIMBALED WORKPIECE HOLDER

Problem: In initial work with high speed lapping systems, a gimbaled workpiece holder had been used. This provided unsatisfactory results in that relatively cone-shaped surfaces were produced. This effect was primarily due to the fact that the interior region of the lapping abrasive surface is moving slower than the outside region (radially outside) of the lapping abrasive surface. Less grinding per rotation was being performed on the interior region, less material was being removed, and so the interior region of the workpiece was higher in the relative topography of the surface, producing the cone-like structure. Hydroplaning effects of liquid between the platen and the workpiece also contributed to an unevenness in surface smoothness, as did uneven wear in the different regions of the abrasive sheet surface. The basic system of the platen covered with abrasive sheet material, rotated at high speeds (e.g., 2,000+rpm) and a gimbaled workpiece would produce surfaces with light band uniformity of at best 4–5 light bands smoothness, and this was attainable only through constant and severe control of the system.

Solution: The combination of a platen surface with an annular ring of abrasive material (e.g., with the non-abrasive inner region comprising at least 20% of the total area of a circle defined by the outer circumference of the annular abrasive sheet) when used in combination with a gimbaled workpiece holder has been found to improve surface smoothness as compared to a continuous surface of abrasive material. The light band smoothness is reduced to 1–2 light bands. It has been surprising to find that in spite of the improvements in speed and/or smoothness normally attained with the highest ranges of platen rotation in other configurations, the combination of gimbaled workpiece and annular abrasive sheet provides the smoothest surface effects at 400–1500 rpm, more preferably about 500–100 rpm, and most preferably at about 500–750 rpm. With the annular abrasive sheet with a gimbaled workpiece, lapping times of from 15–60 seconds at 1000 rpm are used to 100–200 seconds at 500 rpm. With comparable times of 30 seconds at 1000 rpm and 120 seconds at 500 rpm having been noted.

The gimbaled workpiece holder is desired in more conventional lapping apparatus as it is difficult to align the upper workpiece holder perfectly perpendicular to the abrasive platen surface. Even if it is initially aligned, it becomes even more difficult to retain that alignment with disturbance from hydroplaning forces and other machine factors, such as uneven bearings, other dynamic forces, and the like. The combination of the gimbaled workpiece holder with annular sheets of abrasive material attenuates or substantially eliminates some of these effects and problems.

32. RIGID WORKPIECE HOLDER AND POSITIONABLE ABRASIVE PLATEN

Problem: It is desirable to be able to provide a system where only one of the workpiece and lapping platen are needed to be moved during operation of the system. There has been no effective lapping apparatus which has been able to provide the complete control over positioning of the platen face and the workpiece face during lapping which would produce high quality smoothness at high speeds. Because of the high speed component of the present lapping apparatus, the ability for accurate and fast alignment of the surfaces (lapping and workpiece) is much more important than in previous systems. The lapping process for slurries of abrasive or lower speed lapping with abrasive sheet materials (especially in combination with adhesively secured sheets) would take hours. The amount of material removed from surfaces with maximum rotational speeds of 200 rpm was very small and took a large amount of time. In the lapping process, it is often is not always necessary to replace abrasive material during the complete procedure. The abrasive had to be changed because first coarser than finer abrasive material had to be sequenced to rough grind, then polish, then lap the surface. The slow rotational speeds increased the amount of time needed for each step. The need to remove abrasive sheets secured by adhesive was especially slow and unwieldy because of the need to strip the adhesively secured sheet from the platen, remove excess adhesive, and reposition a new sheet with new adhesive. Additionally, even with adhesive removal between sheets, there was a likelihood of adhesive buildup.

Solution: A heavy support frame for the workpiece and lapping platen (including rotation engine or motor) is provided in combination with a preferably fixed workpiece holder secured to the heavy frame. The lapping portion of the system (the motor and lapping platen) is carried on a heavy frame. The workpioece support or workpiece platen (along with gearing or in combination with the motor) is positionable in three axes (the x, y and z axes). Each axis is separately controllable, with an extensive amount of positioning being capable in the axis controlling the linear spacing between the abrasive platen and the workpiece (the x axis), e.g., can be measured in full meters. However, in addition to any gross maneuverability of the workpiecee platen along these three axes, there must also be a control system in place for at least the y and z axes (the vertical alignment and the depth or angular width component, respectively) which is much finer. The fine controls on the system would require that there be at least one hundred (100) positions available within any centimeter of movement along either axis, more preferably at least 250 positions, still more preferably at least 500 or 750 positions available within any cm of movement, and most preferably that there be at least 100, 250, 500 or 750 positions available for every millimeter of movement of the platen face along anyone of and all of the three axes of movement of the platen face. The degree of control may also be measured as with respect to the rotation of a control element. That is, there may be 36, 72, 120, 144, 180, 200, 240, 300, or 360 individual positions within a single rotation position of a control or switch. These numbers have been selected merely because of their relationship to 360°, which is the basic unit for a rotation, but any other unit or number may be selected, as between 1 and 100,000. The actual construction the best working model of the present invention uses position control with a stepping motor having 50,000 step increments per revolution, which divides the forward motion from a single rotation into 50,000 units of travel. Units of more 5,000, more than 10,000 and more than 25,000 are particularly desirable. Each revolution of the control means may have as little movement of the directed portion of the platen (e.g., one edge moving along one axis) as less than 0.05 mm, preferably less than 0.005 mm, still more preferably less than 0.001 mm, and the like.

Positioning along these axes can be effected by any means which can move the platen face with accuracy. Screw pins and screw drives have proved easy to configure into the system because the pitch of the screw can be adjusted to control the amount of linear movement along an axis with respect to any particular amount of screw rotation. For example, with a screw drive having 1 thread per cm, a 360° turn would advance the screw and any part attached thereto by one mm. A 36° rotation would advance the screw 0.1 mm. Similarly, with 5 threads per mm., a complete rotation of the screw head would advance the screw and any attached workpieces or platens 0.2 mm., and a 36° rotation would advance the screw 0.02. Thus the sharpness or fineness of the control can be designed by the threading of screws.

The mass of the frame also has a beneficial effect upon the performance of the system. As the system is subjected to vibration forces, it is desirable to minimize these forces. This can be done in a number of ways, but the easiest way to have a major impact on controlling vibration is to increase the mass of the support system and the connectors of the workpiece holders and the abrasive platen. The frame of the system should weigh a minimum of 100 kg. For a lightweight, small manufacturing model. More preferably at least 200 kg, still more preferably at least 350 kg. And most preferably at least 500 kg., with no maximum weight contemplated except by the limitations of reasonableness. The weight of the actual commercial embodiment of the present invention is about 600 kg.

The apparatus described in this section would generally be a lapper platen system comprising:

a) a shaft which is connected to a rotatable platen, said platen having a back side to which said shaft is connected and a flat front side on said platen to which can be secured an abrasive sheet;

b) a frame having a total weight of at least 200 kg supporting a work piece holder and said shaft connected to a rotatable platen;

c) said rotating is attached to a movable element which is capable of moving along said frame in a direction towards and away from said work piece to be lapped, d) said shaft having control element thereon which allow for independent movement and alignment of said shaft along three perpendicular axes so that said flat face of said platen can move towards parallelity with said work piece to be lapped; and e) said control elements having at least 50 settings per rotation, each setting moving said shaft along one of said three axes by a dimension less than 0.05 mm.

33. ADDITION OF FINE SLURRY BETWEEN THE ABRASIVE SHEET AND THE PIECE PART

It has been found that, especially with the use of a slurry with a traditional work piece such that the slurry band is considerably more narrow than the rotating work piece, then the effects of different relative speds and boundary layer thickness at the inner and outer radius is diminished and the ground part would be flatter. A slurry of abrasive particles to the lubricant, collant (e.g., water) can be used with the coated diamond abrasive sheets. These particles could be larger or smaller than the average diameter of the diamond particles, and have a controlled size distribution to enhance the perfromance of he abrasive disk. Different types of chemical additives could also be added to the liquid composition provided between the disk and the work piece, such as surfactants, viscosity modifying (reducing or thickening) agents, etc. Some seletcively chosen foreign matter could also be added to the slurry mix, such as glass beads, plastic beads, fibers, fluorescent materials, phosphorescent materials (for examination of the face of the work piece by other means). The diffrent solid or abrasive materials in the slurry could perform a surface separation effect to obtain flatter contact between the work piece and the abrasive sheeting. The other additives would have to be considered on an individual basis as a function or relationship of the type of abrasive used in each portion of the grinding cycle and the make-up of the work piece and its compatability with the chemical make-up of the additives. The combination of different abrasive particles with the diamond sheeting can provide unique lapping effects and intermediate effects between traditional lapping with slurry compositions and the high speed abrasive sheet grinding of the present invention.

What is claimed:

1. A process for lapping a surface comprising:

a) providing a work piece to be lapped, having at least one surface to be lapped which can be adjusted to a position parallel to said at least one surface of a rotating platen, b) providing a rotating platen having i) a back surface and ii) a front surface with a periphery, said front surface of said rotating platen having a raised edge symmetrically disposed about said periphery, c) providing a sheet of abrasive material having an abrasive face and a back side onto said raised edge to provide a symmetrical distribution of abrasive material on said rotating platen, said back side being on said front surface of said platen with the abrasive face of said sheet facing said at least one surface to be lapped, d) securing said sheet of abrasive material to said front surface of said rotating platen, and (1) rotating said rotating platen at a rotational speed of at least 500 revolutions per minute, and (2) contacting said abrasive face and said at least one surface to be lapped on said work piece.

2. The process of claim 1 wherein said sheet of abrasive material comprises a surface having abrasive particles with an average diameter of from 1 to 100 micrometers.

3. The process of claim 1 wherein said abrasive surface comprises diamond particles having an average diameter of less than 50 micrometers.

4. The process of claim 3 wherein said platen is rotated at a speed of at least 2,000 rpm and an outer edge of abrasive sheet on said raised edge moves with a surface speed of at least 4,000 surface feet per minute relative to said surface to be lapped.

5. The process of claim 1 wherein said sheet of abrasive material is round.

6. The process of claim 5 wherein said round sheet has a) an outer edge and b) an inner edge defining a cut-out portion, and said sheet comprises an annular sheet, said inner edge having a diameter which is greater than one-third the diameter of said outer edge.

7. The process of claim 3 wherein said sheet is round and said round sheet has an outer edge and an inner edge defining an abrasive-free area and comprises an annular sheet, said inner edge having a diameter which is greater than one-third the diameter of said outer edge.

8. The process of claim 6 wherein during rotation of said platen a liquid is placed between said sheet and said work piece, said liquid forms a boundary layer as it moves from an inner portion of said sheet to an outer portion of said sheet, said sheet comprising abrasive particles which protrude by an average height on said surface of said sheet, and said boundary layer is less than 50% of the average height of abrasive particles protruding from said sheet.

9. A process for lapping a surface comprising:

a) providing a work piece to be lapped, having at least one surface to be lapped which can be adjusted to a position parallel to said at least one surface of a rotating platen with abrasive thereon, said work piece being supported by a work piece holder on a pivot joint, b) providing a rotating platen having i) a back surface, ii) a front surface, and iii) a raised edge forming an abrading plateau on said front surface of said rotating platen, said abrading plateau having a sheet of abrasive material having an abrasive face and a back side, and said back surface pivotally connected to a rotating joint which is in turn connected to a shaft which rotates said platen, c) said abrasive face of said sheet facing said at least one surface to be lapped, d) securing said sheet of abrasive material to said flat surface of said platen, and e) rotating said platen at a rotational speed of at least 500 revolutions per minute by rotating said shaft, and f) contacting said abrasive face and said at least one surface to be lapped on said work piece, and allowing said work piece to pivot around said pivot joint so that said abrading plateau and said at least one surface to be lapped become more parallel towards each other.

10. The process of claim 9 wherein pressure is applied between said work piece and said abrasive sheet by a gimbal pivot joint supporting said work piece.

11. A process for lapping a surface according to claim 1 wherein said front surface of said rotating platen facing said work piece has a flat plateau which is continuous around a perimeter of said front side of said platen and is elevated with respect to a central area on said front side, providing a sheet of abrasive material on said flat plateau, said sheet of abrasive material having a front surface with an abrasive face and a back surface, with said abrasive face facing said at least one surface to be lapped, securing said sheet of abrasive material to said flat surface of said plateau, and rotating said platen at at least 500 revolutions per minute and contacting said abrasive material and said work piece to remove material from said work piece.

12. The process of claim 11 wherein said plateau defines an annular shape on said front face.

13. The process of claim 12 wherein said platen is round.

14. The process of claim 12 wherein said sheet of abrasive material comprises an annular portion and a central open portion in which the central open portion is at least three times the radial dimension as the width of said annular portion.

15. The process of claim 14 wherein said sheet comprises an annular distribution of abrasive material on a backing material, with a center area of said sheet being a self-supporting structure which passes across said center area, contacting inner edges of said annular distribution of abrasive material.

16. The process of claim 15 wherein said abrasive sheet comprises a continuous substrate with a central area having no abrasive on said backing material, and an annular zone of said backing material surrounding said central area having abrasive material on a surface overlaying said plateau and facing away from said platen.

17. The process of claim 13 wherein said abrasive sheet comprises an annular zone and said central area, said central area being bonded to said annular zone, having less height than said annular zone when said sheet is lying flat, and there being a seam between said annular zone and said central area.

18. A lapper platen system comprising:

a) a rotatable platen having i) a back surface and ii) a front surface, wherein said front surface of said rotating platen facing a work piece and said front surface has a flat plateau which is continuous around a perimeter of said front side of said platen and is elevated with respect to a central area on said front surface and is defined by an area bounded by two concentric circles having different diameters, b) said front surface also having vents for air, c) said platen having a back side to which a shaft is connected and a front side on said platen to which is secured an abrasive sheet by reduced air pressure conveyed through said vents, d) said back side also being connected to said shaft which rotates said platen;

e) a frame having a total weight of at least 200 kg supporting a work piece holder and said shaft connected to a rotatable platen, f) a work piece holder which is movable on said frame;

g) said work piece holder is attached to a movable element on said frame which is capable of moving along said frame in a direction towards and away from said platen to perform lapping of a work piece held on said work piece holder, h) said work piece holder having control element thereon which allow for independent; movement and alignment of said work piece holder along three perpendicular axes so that a work piece on said work piece holder can be adjusted and oriented towards parallelity with said platen so that a work piece can be lapped; and i) said control elements having at least 1,000 settings per rotation, each setting moving said shaft along one of said three axes by a dimension less than 0.001 mm.

19. A lapper system comprising:

a) a shaft which is connected to a rotatable platen having on a front surface of said platen vents for air, said rotatable platen having a back side to which said shaft is connected and a flat front side on said rotatable platen to which can be secured an abrasive sheet by reduced air pressure conveyed through said vents;

b) a frame having a total weight of at least 200 kg supporting a work piece holder and said shaft connected to a rotatable platen;

c) a work piece holder which is movable on said frame;

d) said work piece holder is attached to a movable element on said frame which is capable of moving along said frame in a direction towards and away from said platen to perform lapping of a work piece held on said work piece holder;

e) said work piece holder having control element thereon which allow for independent movement and alignment of said work piece holder along three perpendicular axes so that a work piece on said work piece holder can be adjusted and oriented towards parallelity with said rotatable platen so that a work piece can be lapped; and f) said control elements having at least 1000 settings per rotation, each setting moving said shaft along one of said three axes by a dimension less than 0.005 mm;

wherein said lapper system includes a pivoting lapper platen system comprising:

g) a shaft which is connected to said rotatable platen, said rotatable platen having a back side to which said shaft is connected and a front side on said rotatable platen to which can be secured an abrasive sheet, said rotatable platen having i) a back surface, ii) a front surface, and iii) a raised edge forming an abrading plateau on said front surface of said rotatable platen, with an abrasive sheet secured to said raised edge.

20. The lapping system of claim 19 further having a pivoting joint comprising a shaped element selected from the group consisting of spherical and torroidal elements comprising a curved outside surface, and said pivoting joint being secured to said work piece holder, said pivoting joint having an arcuate surface area and a receding surface area of said outside surface of said pivoting joint, and said receding surface area is closest to said work piece holder;

said pivoting joint having a cross section with an effective center of its area, said receding surface area of said pivoting joint being defined by a surface which has average distances from said effective center which are smaller than the average distances from said effective center to said arcuate surface area;

a) arcuate surface area of the pivoting joint is supported by at least one pair of arcuate-faced bearings, said bearings comprising at least one upper bearing and at least one lower bearing, said bearings being attached to a portion of said work piece holder, and allowing said pivoting joint to pivot between said at least one pair of bearings;

b) said work piece holder being able to pivot about said pivot joint relative to said platen.

21. The lapper system of claim 20 wherein above said at least one upper bearing is a space between said shaft and a neck of said work piece holder, said shaft being restrained within said space by a cushioning means between said shaft and an interior surface of said neck, said cushioning means being selected from the group consisting of flexible compositions and springs.

22. The lapper system of claim 21 wherein said cushioning means comprises a flexible composition.

23. The lapper system of claim 21 wherein said cushioning means comprises an elastomeric composition.

24. The lapper system of claim 23 wherein between said flexible composition and said at least one upper bearing is a spring element, and above said spring element and below said flexible composition is a securing element, said securing element being capable of being adjusted in a direction parallel to said shaft to increase force upon said spring element, said force on said spring element in turn increasing force of said at least one upper bearing to press said bearing against an arcuate surface of said pivoting joint.

25. The process of claim 9 wherein said abrasive sheet is secured to said rotating platen by a vacuum.

26. The process of claim 9 wherein said rotating platent is moving at at least 8000 surface feet per minute at the outer edge of said platen.

27. The process of claim 9 wherein said abrasive sheet comprises a continuous sheet of material with an annular ring of abrasive thereon.

28. The process of claim 9 wherein said abrasive on said abrasive sheet comprises metal plated diamond islands.

29. The process of claim 9 wherein said work piece is secured to said work piece holder by vacuum.

30. The process of claim 29 wherein adhesive tape is applied to a back side of said workpiece, and then the work piece with tape on its back side is secured to said work piece holder by said vacuum.

31. The process of claim 9 wherein the front surface of said platen has an inner edge and an outer edge, and at least one of the inner edge and outer edge are angled away from contact with work piece holder.

32. The process of claim 9 wherein a safety box surrounds said platen and work piece holder and is struck by debris from said work piece as said platen rotates.

33. The process of claim 9 wherein said abrasive sheet has an annular distribution of abrasive and said work piece holder is oscillated across a full width of said annular distribution of abrasive.

* * * * *

UNITED STATES PATENT AND TRADEMARK OFFICE

CERTIFICATE OF CORRECTION

PATENT NO. : 5,910,041

DATED : Jun. 8, 1999

INVENTOR(S) : Wayne O. Duescher

It is certified that error appears in the above-identified patent and that said Letters Patent is hereby corrected as shown below:

At Col. 49, line 46, please delete ";" following "independent".

Signed and Sealed this

Twenty-first Day of December, 1999

*Attest:*

Q. TODD DICKINSON

*Attesting Officer*

*Acting Commissioner of Patents and Trademarks*